US008377231B2

(12) United States Patent
Richards et al.

(10) Patent No.: US 8,377,231 B2
(45) Date of Patent: Feb. 19, 2013

(54) APPARATUS AND METHOD FOR CLEANING A COKER OR OTHER VESSEL

(75) Inventors: Dan Richards, Fort McMurray (CA); David J. Whitlock, Sherwood Park (CA); Brian Fitzmaurice, Sherwood Park (CA); Mike Bronson, Edmonton (CA)

(73) Assignee: CEDA International Corporation (CA)

( * ) Notice: Subject to any disclaimer, the term of this patent is extended or adjusted under 35 U.S.C. 154(b) by 2435 days.

(21) Appl. No.: 10/522,627

(22) PCT Filed: Apr. 11, 2003

(86) PCT No.: PCT/CA03/00541

§ 371 (c)(1),
(2), (4) Date: Jan. 31, 2005

(87) PCT Pub. No.: WO2004/015027

PCT Pub. Date: Feb. 19, 2004

(65) Prior Publication Data

US 2005/0252528 A1 Nov. 17, 2005

(30) Foreign Application Priority Data

Aug. 12, 2002 (CA) ..... 2397509

(51) Int. Cl.
*B08B 9/00* (2006.01)

(52) U.S. Cl. ..... 134/166 R; 134/167 R; 134/198

(58) Field of Classification Search ..... None
See application file for complete search history.

(56) References Cited

U.S. PATENT DOCUMENTS

| | | | | |
|---|---|---|---|---|
| 3,285,485 | A * | 11/1966 | Slator | 226/172 |
| 3,520,724 | A * | 7/1970 | Massa | 134/1 |
| 3,645,452 | A | 2/1972 | Stoeckel et al. | |
| 3,920,537 | A | 11/1975 | Walker | |
| 4,799,554 | A * | 1/1989 | Clapp et al. | 166/312 |
| 4,828,651 | A | 5/1989 | Lumbroso et al. | |
| 5,036,871 | A | 8/1991 | Ruggieri et al. | |
| 5,129,455 | A * | 7/1992 | Boisture | 165/95 |

(Continued)

FOREIGN PATENT DOCUMENTS

| | | |
|---|---|---|
| CA | 1295897 | 2/1992 |
| CA | 2074204 | 4/2000 |

OTHER PUBLICATIONS

Mallory, Donald G. et. al., "The Role of the Vapour Phase in Fluid Coker Cyclone Fouling: Part 1. Coke Yields," Cdn. J. of Chem. Eng., vol. 78, No. 2, Apr. 2000, pp. 330-336.

(Continued)

*Primary Examiner* — Eric Golightly
(74) *Attorney, Agent, or Firm* — Mark A. Oathout; Oathout Law Firm

(57) ABSTRACT

An apparatus and method for cleaning a vessel are disclosed. The vessel may include a coker for the extraction of crude oil, for example. The apparatus may include an elongated flexible conduit insertable through an elongated rigid conduit into the vessel, for conducting pressurized liquid into the vessel to clean the vessel. The apparatus preferably includes a sealing device for sealing a gap between the flexible conduit and the rigid conduit to prevent fluid from travelling through the gap.

6 Claims, 24 Drawing Sheets

U.S. PATENT DOCUMENTS

| | | | | |
|---|---|---|---|---|
| 5,286,154 | A | 2/1994 | Jens et al. | |
| 5,330,970 | A * | 7/1994 | Reid et al. | 507/90 |
| 6,199,566 | B1 * | 3/2001 | Gazewood | 134/166 C |
| 6,206,317 | B1 * | 3/2001 | Harvestine | 242/395 |
| 6,513,462 | B1 | 2/2003 | Shiraishi et al. | |
| 2002/0046833 | A1 | 4/2002 | Perio, Jr. | |

OTHER PUBLICATIONS

International Search Report dated Jun. 17, 2003 provided by the European Patent Office as the ISA in PCT International Application PCT/CA2003/000541 (4 pages).

* cited by examiner

FIG. 6
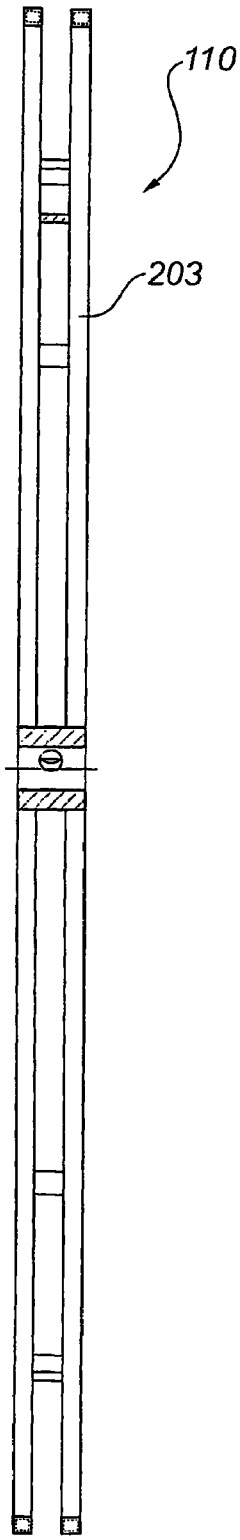
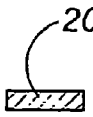
FIG. 7
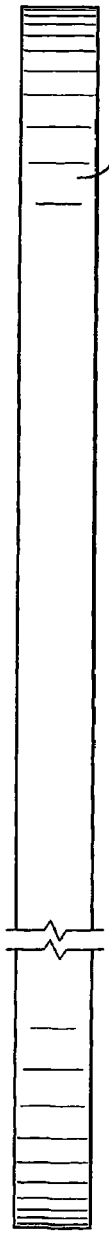
FIG. 8
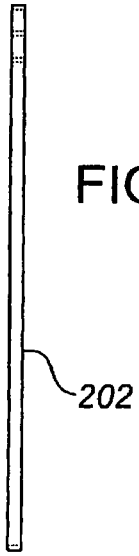
FIG. 9
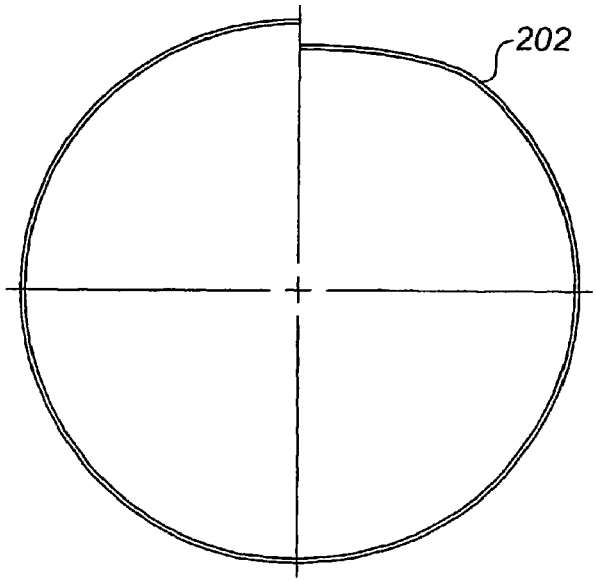
FIG. 10

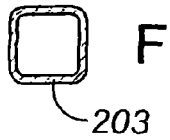
FIG. 11
FIG. 12
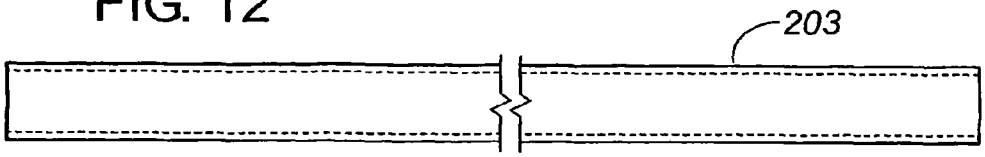
FIG. 13
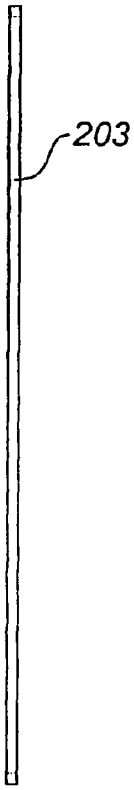
FIG. 14
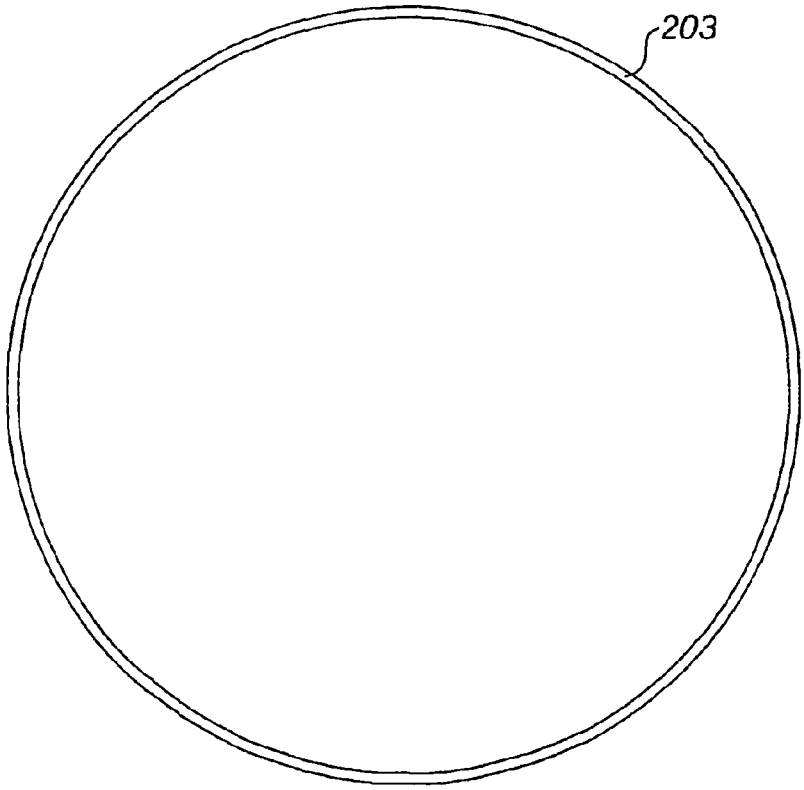

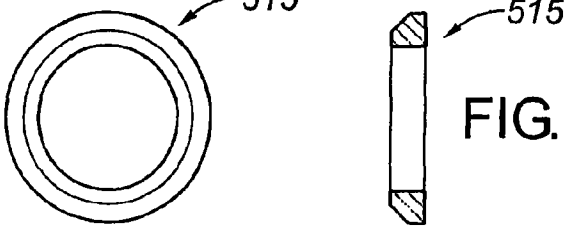
FIG. 66
FIG. 65
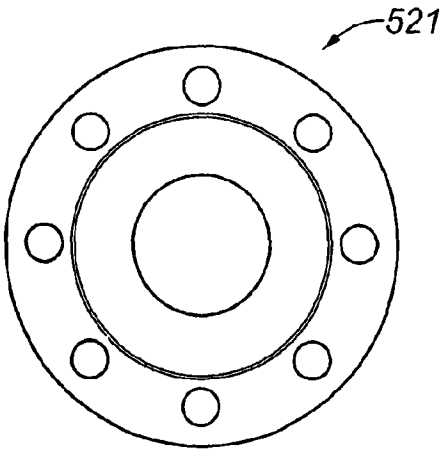
FIG. 67
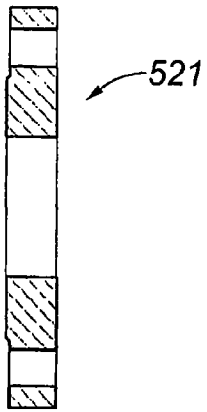
FIG. 68
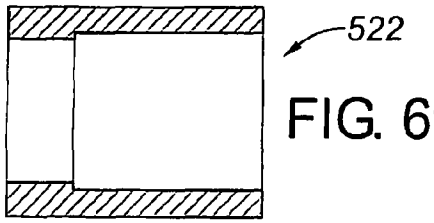
FIG. 69
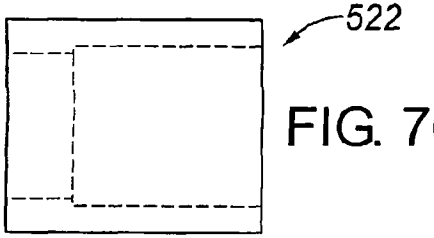
FIG. 70
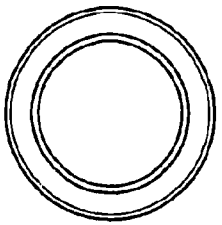
FIG. 71

APPARATUS AND METHOD FOR CLEANING A COKER OR OTHER VESSEL

FIELD OF INVENTION

The present invention relates to apparatuses and methods for cleaning a vessel, such as a coker vessel used in the manufacture of crude oil, for example.

BACKGROUND OF INVENTION

Many types of vessels pose cleaning difficulties. One type of vessel in which particularly disadvantageous cleaning difficulties arise is a coker for use in extracting crude oil from solid materials (e.g. sand), such as a particular type of dense phase cyclone reactor coker manufactured by Exxon Corporation, for example. Such cokers typically have a plurality of "snouts" (usually 4-6 snouts) disposed circumferentially around the inside of an upper region of the coker. Each snout may include a 24 inch (61 centimetre) elbow joint for example, and is typically in communication with a respective 24 inch (61 centimetre) gas tube extending vertically downward within the coker. Below the gas tube is a void area for the cyclone effect, and a dip leg extending beneath the void area. Cokers of this type are typically on the order of 100 metres (several hundred feet) tall, and a typical distance from the top of the snout to the bottom of the dip leg may be about 85 feet (26 metres), for example.

Such cokers typically operate at internal temperatures in excess of 450° C. (approximately 850° F.), and internal air velocities in excess of 150 m/s (500 ft/s). Cokers of this type are typically designed to operate continuously, 24 hours a day, 365 days per year, with a typical output in the range of 75,000 or more barrels of crude oil per day.

Over time, however, coke deposits tend to build up within various internal components of the coker, such as the snouts, gas tubes and dip legs, gradually decreasing the efficiency of the oil-solid separation process. When the process efficiency becomes too low, the coker must be shut down for manual internal cleaning. Due to the internal operating conditions of the coker, such coke deposits are typically as hard as concrete, and are difficult to clean. Accordingly, it is not uncommon for the cleaning process for dense phase cyclone reactor cokers to take 30 days or more, resulting in tens of millions of dollars in clean-up costs and lost revenues.

One approach to this problem involves inserting a rigid pipe through a valve in a side wall of the coker, at the approximate height of the snouts (which may be about 220 feet or 67 metres above the bottom of the coker, for example). The rigid pipe is pushed into a mouth of one of the snouts, and high-pressure water is pumped through the pipe into the mouth of the snout and down the gas tube, to attempt to dislodge the coke deposits. However, although this approach is effective in removing coke from the mouth region of the snout, it is progressively less effective in removing coke from portions of the gas tube and dip leg located further down within the coker. Thus, this method merely prolongs the period of time for which the coker may be operated before a cleaning shut-down is required, rather than preventing a shut-down.

Accordingly, there is a need for an improved method of cleaning a vessel. There is also a need for a method and apparatus for cleaning a vessel which can be used while the vessel is in operation or is "live".

SUMMARY OF INVENTION

In accordance with one aspect of the invention, there is provided an apparatus for cleaning a vessel. The apparatus includes an elongated flexible conduit insertable through an elongated rigid conduit into the vessel, for conducting a pressurized fluid, preferably a liquid, into the vessel to clean the vessel.

The apparatus preferably includes a sealing device for sealing a gap between the flexible conduit and the rigid conduit to prevent fluid from travelling through the gap.

The apparatus may include the rigid conduit, which may include a rigid shroud extending into the vessel and having a shape complementary to that of the flexible conduit. If so, the shroud may be insertable through an opening defined in a wall of the vessel. For example, the shroud may be insertable through an elongated rigid valve assembly extending through a wall of the vessel. The apparatus may include a sealing device for sealing a gap between the shroud and the valve assembly to prevent fluid from travelling through the gap.

The flexible conduit preferably is capable of conducting the liquid at a pressure of at least 5,000 psi, or more particularly, at least 10,000 psi.

The flexible conduit may be sufficiently long to be inserted through the rigid conduit into a coker vessel.

The flexible conduit may include a nozzle at a tip thereof. If so, the flexible conduit may be sufficiently long for the nozzle to be inserted through the rigid conduit past an innermost opening of the rigid conduit within the coker vessel.

The flexible conduit is preferably sufficiently long for the nozzle to be inserted into a snout of the coker vessel. More particularly, the flexible conduit is preferably sufficiently long for the nozzle to be inserted through the snout, into and through a gas tube of the coker vessel, into and through a cyclone region of the coker vessel, and into a vicinity of a dip leg of the coker vessel.

The elongated flexible conduit may include coiled tubing. If so, the apparatus may include a reel for storing the coiled tubing in a coil on the reel.

The reel may include a liquid junction connectable to an input end of the coiled tubing and connectable to a liquid supplying device for conducting the pressurized liquid from the liquid supplying device into the coiled tubing. The liquid junction may include a high-pressure fluid swivel connector, for example.

The apparatus may include the liquid supplying device. The latter device may include a pump and a hose connectable to the pump and to the liquid junction.

The reel may further include at least one retaining member for retaining the coiled tubing on the reel.

The apparatus may include an insertion device for inserting the flexible conduit through the rigid conduit into the vessel. The insertion device may include an injector assembly operable to grip the flexible conduit and push the flexible conduit through the rigid conduit.

The injector assembly may include first and second opposing traction belts operable to snugly grip the flexible conduit therebetween. The injector assembly may further include at least one drive mechanism for rotating the traction belts in opposite respective directions to move the flexible conduit through the injector assembly.

In accordance with another aspect of the invention, there is provided a method of cleaning a vessel. The method includes inserting an elongated flexible conduit through an elongated rigid conduit into the vessel, and conducting pressurized liquid through the flexible conduit into the vessel to clean the vessel.

The method preferably includes sealing a gap between the flexible conduit and the rigid conduit to prevent fluid from travelling through the gap.

The method may include inserting the flexible conduit through a rigid shroud extending into the vessel and having a shape complementary to that of the flexible conduit.

The method may include inserting the shroud through an opening defined in a wall of the vessel. This may include inserting the shroud through an elongated rigid valve assembly extending through the wall of the vessel, for example.

The method may include sealing a gap between the shroud and the valve assembly to prevent fluid from travelling through the gap.

Conducting may include conducting the liquid at a pressure of at least 5,000 psi, preferably at a pressure of at least 10,000 psi.

Inserting may include inserting the flexible conduit through the rigid conduit into a coker vessel. This may include inserting a nozzle at a tip of the flexible conduit through the rigid conduit past an innermost opening of the rigid conduit within the coker vessel.

Inserting may include inserting the nozzle into a snout of the coker vessel, through the snout into a gas tube of the coker vessel, through the gas tube into a cyclone region of the coker vessel, and through the cyclone region into a vicinity of a dip leg of the coker vessel.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention,

FIG. 6 is an end view of the reel shown in FIG. 4;

FIGS. 7-10 show a reel drum plate of the reel shown in FIG. 4;

FIGS. 11-14 show a reel outer rim of the reel shown in FIG. 4;

FIGS. 65-66 show a retainer ring of the tube assembly shown in FIG. 54;

FIGS. 67-68 show a packing cylinder flange of the cylinder assembly shove in FIG. 56;

FIGS. 69-71 show a packing cylinder of the cylinder assembly shown in FIG. 56;

FIG. 79 is a cross-section of the rigid conduit shown in FIG. 46 and the shroud pack-off shown in FIG. 53, assembled together;

DETAILED DESCRIPTION

Figure 1:
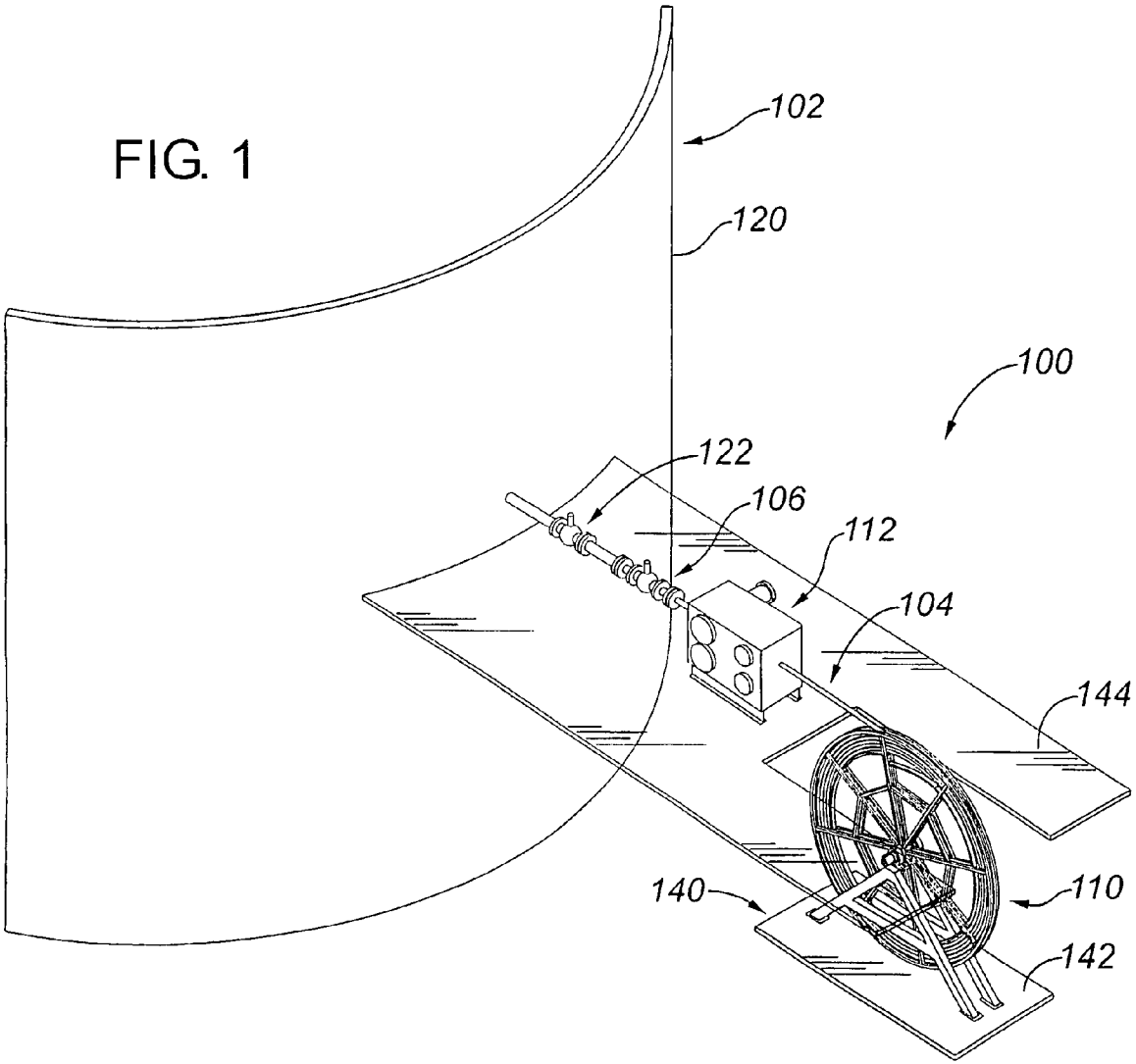
FIG. 1 is a perspective view of an apparatus for cleaning a vessel, according to a first embodiment of the invention.

Referring to FIG. 1, an apparatus according to a first embodiment of the invention is shown generally at 100. In this embodiment, the apparatus 100 is used for cleaning a vessel shown generally at 102, which in this embodiment includes a dense phase cyclone reactor coker. The apparatus 100 is adapted to clean the vessel 102 while the vessel 102 is "live" (i.e., in operation).

In the present embodiment, the apparatus 100 includes an elongated flexible conduit shown generally at 104, insertable through an elongated rigid conduit shown generally at 106 into the vessel 102, for conducting pressurized liquid into the vessel to clean the vessel.

Figure 2:
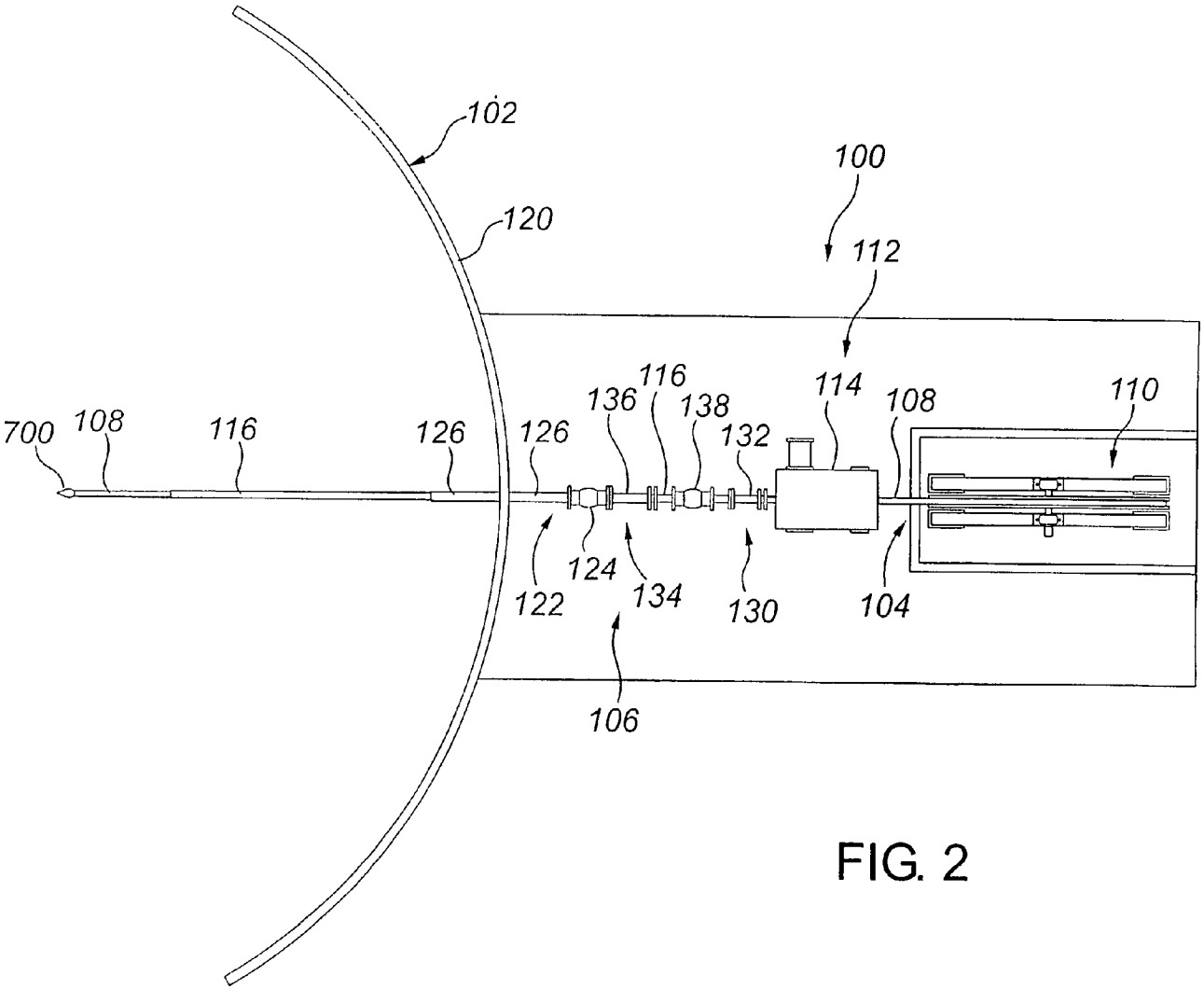
FIG. 2 is a top view of the apparatus shown in FIG. 1.
Figure 3:
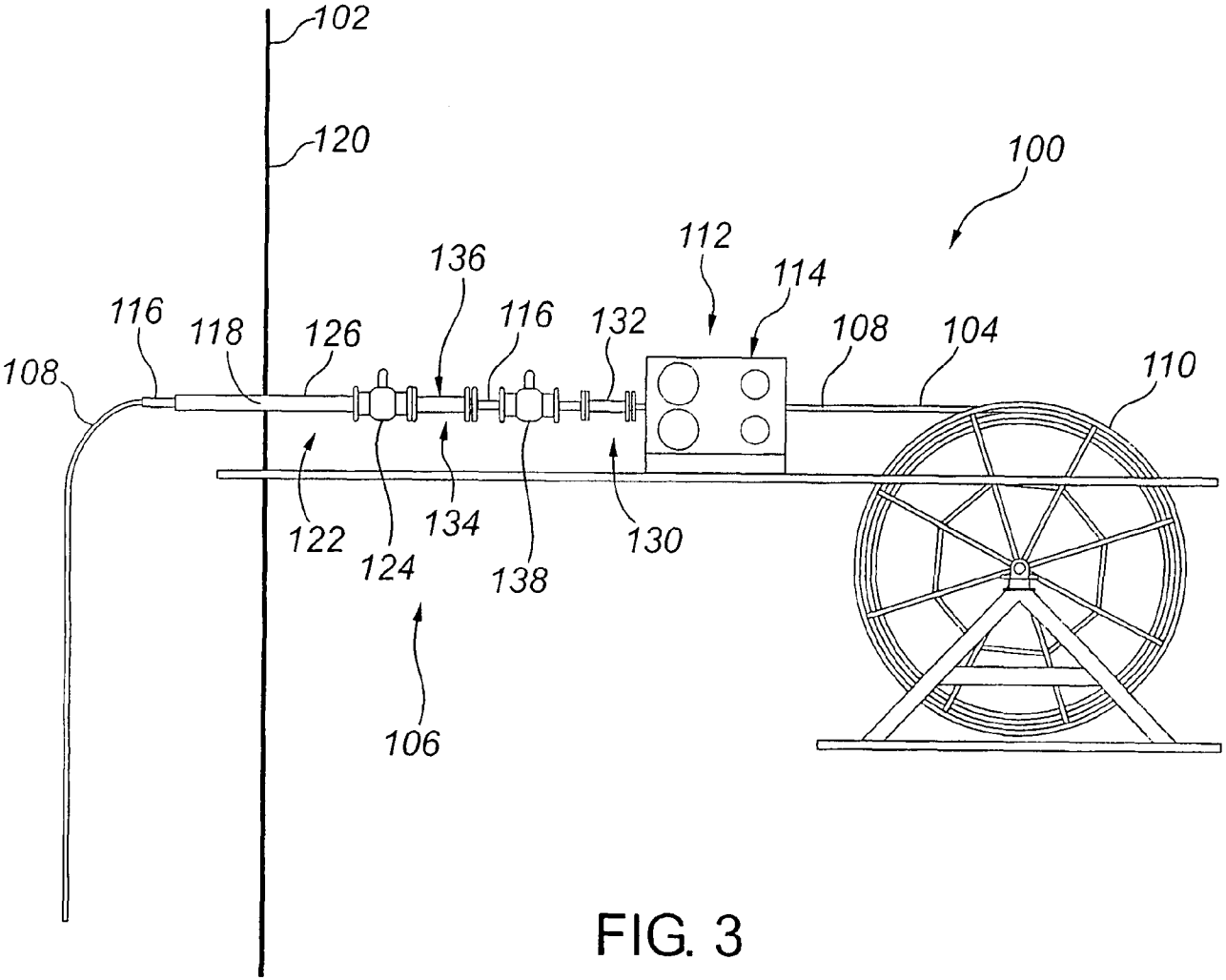
FIG. 3 is a side view of the apparatus shown in FIG. 1.

Referring to FIGS. 2 and 3, the apparatus is shown in greater detail at 100. In this embodiment, the elongated flexible conduit 104 includes coiled tubing 108. In this embodiment, the coiled tubing 108 includes standard carbon oilfield tubing, rated for operation at internal pressures of at least 10,000 psi. The coiled tubing 108 may include standard commercially available coiled tubing used for downhole oilfield applications, for example. In this embodiment, the apparatus 100 further includes a reel 110, for storing the coiled tubing 108 in a coil on the reel.

In this embodiment, the apparatus 100 further includes an insertion device 112 for inserting the flexible conduit 104 through the rigid conduit 106 into the vessel 102. More particularly, in this embodiment, the insertion device 112 includes all injector assembly 114 operable to grip the flexible conduit 104 and push the flexible conduit through the rigid conduit 106. The insertion device 112 is preferably powered by a hydraulic power unit (not shown).

In the present embodiment, the apparatus 100 further includes the rigid conduit 106. In this embodiment, the rigid conduit 106 includes a rigid shroud 116 extending into the vessel 102 and having a shape complementary to that of the flexible conduit 104.

In this embodiment, the rigid shroud 116 is insertable through an opening 118 defined in a wall 120 of the vessel 102. More particularly, in this embodiment, the shroud 116 is insertable through an elongated rigid valve assembly shown generally at 122 extending through the wall 120 of the vessel. In this embodiment, the elongated rigid valve assembly 122 includes an existing valve 124 and a rigid pipe 126 extending through the wall 120 of the vessel 102 on both sides thereof, and connected to the existing valve 124.

In the present embodiment, the apparatus 100 further includes a first sealing device 130 for sealing a gap between the flexible conduit 104 and the rigid conduit 106 to prevent fluid from travelling through the gap. More particularly, the sealing device 130 includes a coiled tubing pack-off 132 for sealing a gap between the coiled tubing 108 and the shroud 116 to prevent fluid from travelling through this gap. Thus, in operation, the first sealing device 130 prevents hot gases from escaping from the vessel 102 through the gap between the coiled tubing 108 and the shroud 116, thereby preventing an operator (not shown) of the apparatus 100 from being injured by such gases, which may exceed 450° C. (850° F.). Similarly, the coiled tubing pack-off 132 prevents ambient air from outside the vessel 102 from entering the vessel during operation, which may interfere with the proper operation of the vessel.

Similarly, in this embodiment, the apparatus 100 further includes a second sealing device 134 for sealing a gap between the shroud 116 and the valve assembly 122 to prevent fluid from travelling through this latter gap. More particularly, the second sealing device 134 includes a shroud pack-off 136 for sealing the gap between the rigid shroud 116 and the rigid pipe 126 of the valve assembly 122, to prevent hot gases or other materials from escaping from the vessel 102 through the gap, or to prevent ambient air from outside the vessel from entering the vessel through the gap.

In this embodiment, the apparatus 100 further includes a shroud valve 138, which may be installed at a portion of the shroud 116 distal from the vessel 102, for preventing gases from travelling out of or into the vessel 102 during installation of the apparatus 100.

Referring back to FIG. 1, the apparatus 100 is supported by a support frame 140, which in this embodiment includes a lower platform 142 and an upper platform 144, which are preferably rigidly attached to one another by attachment members (not shown). The upper platform 144 supports the weight of the insertion device 112 while the lower platform 142 supports the weight of the reel 110 and coiled tubing 108 stored on the reel. The upper platform 144 may also support the weight of personnel (not shown) installing or maintaining the apparatus 100. The support frame 140 may in turn be supported by scaffolding or other structures (not shown), as it is expected that for some applications, the apparatus 100 may be installed at heights of about 220 feet (about 67 metres) above the ground, at the height of the existing valve assembly 122. The power unit (not shown) for the insertion device 112 may also be supported on or by the support frame (140)

Reel

Figure 4:
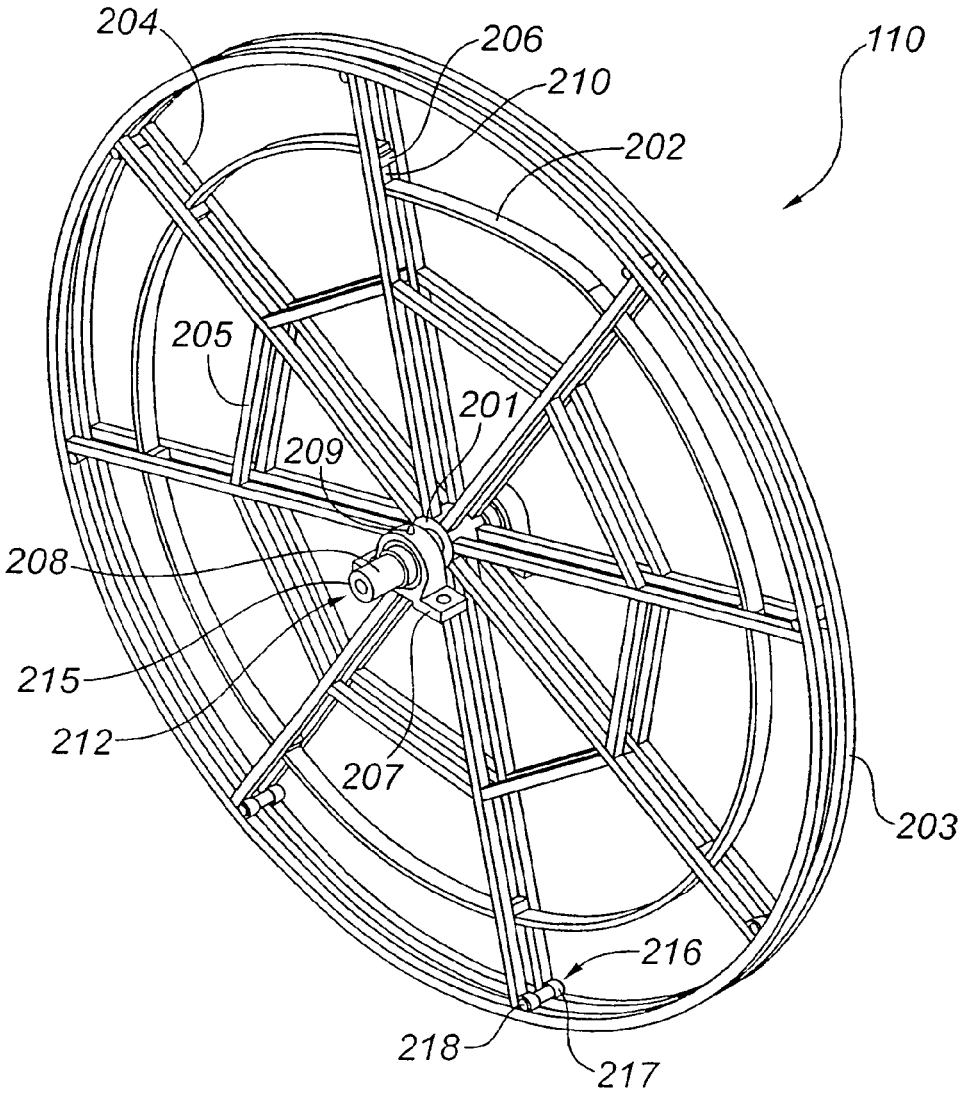
FIG. 4 is a perspective view of a reel of the apparatus shown in FIG. 1.
Figure 5:
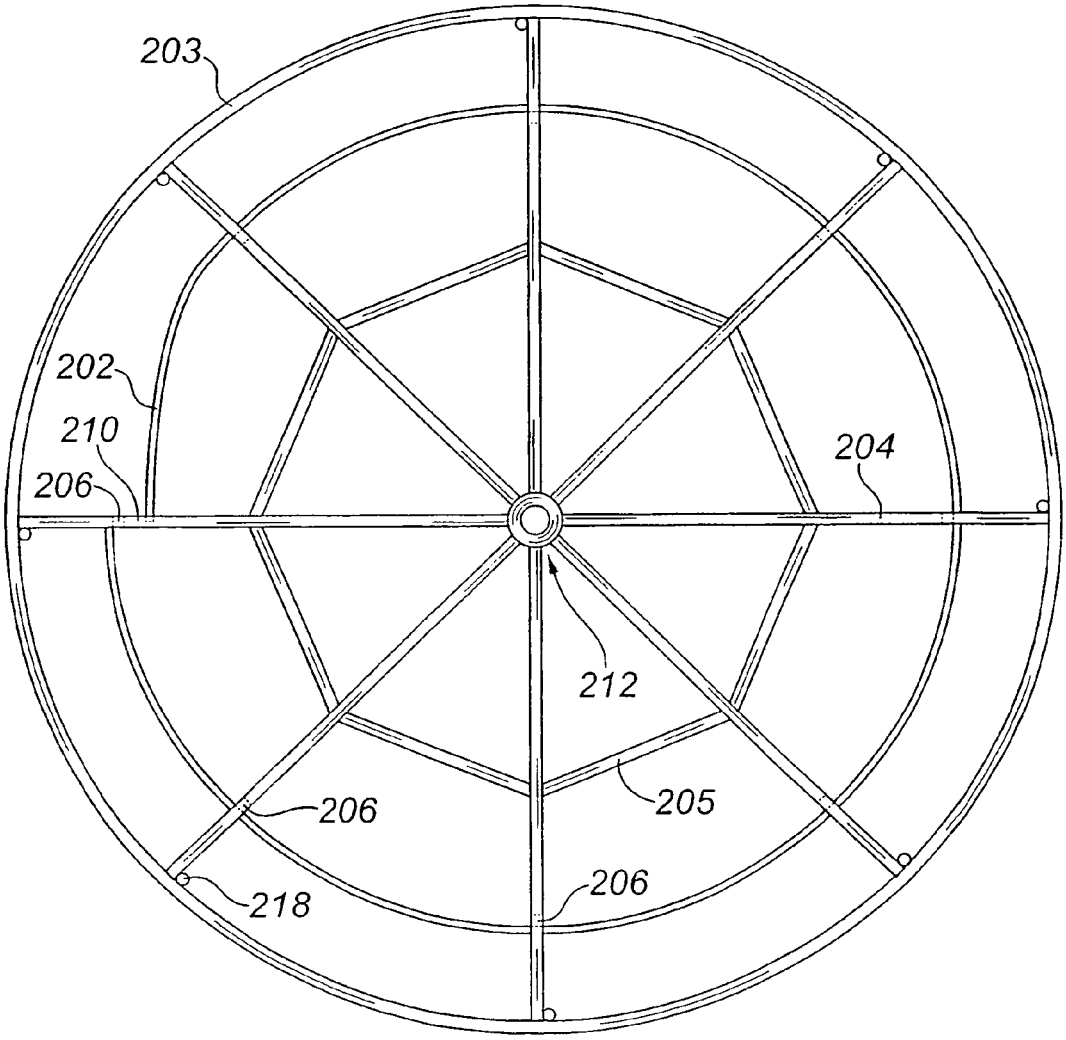
FIG. 5 is a side view of the reel shown in FIG. 4.
Figure 16:
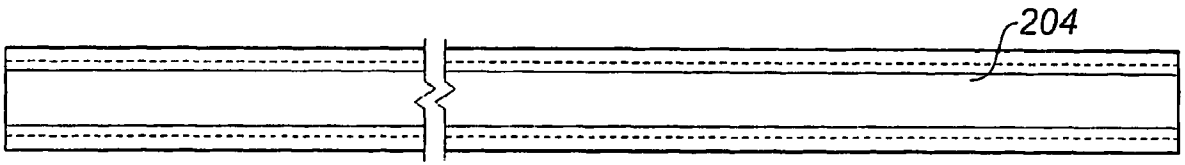
FIGS. 15-16 show reel side bracing of the reel shown in FIG. 4.
Figure 15:
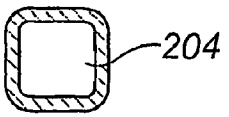
Figure 18:
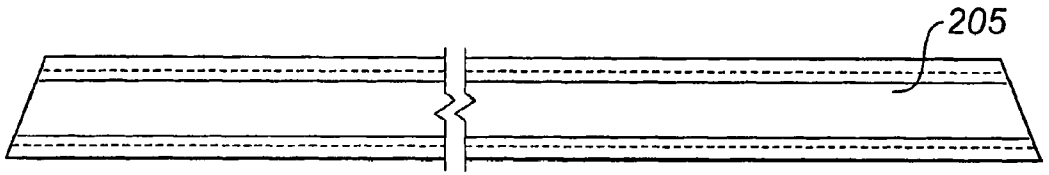
FIGS. 17-18 show reel spoke bracing of the reel shown in FIG. 4.
Figure 17:
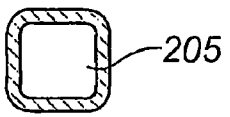
Figure 20:
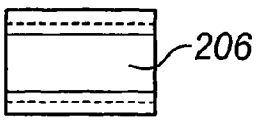
FIGS. 19-20 show reel drum plate supports of the reel shown in FIG. 4.
Figure 19:
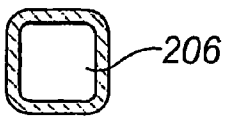
Figure 21:
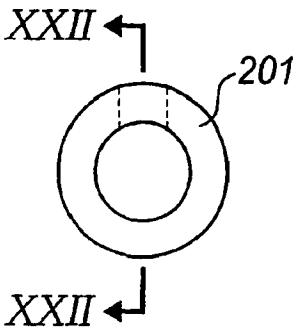
FIGS. 21-22 show a reel sleeve of the reel shown in FIG. 4.
Figure 22:
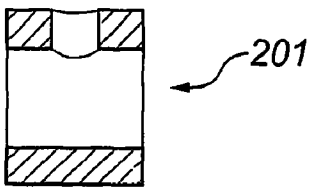

Referring to FIGS. 4 through 28, the reel is shown in greater detail at 110 in FIG. 4. In this embodiment, the reel 110 includes a reel sleeve 201 shown in greater detail in FIGS. 21 and 22, a reel drum plate 202 shown in greater detail in FIGS. 7 through 10, a reel outer rim 203 shown in greater detail in FIGS. 11 through 14, reel side bracing 204 shown in greater detail in FIGS. 15 and 16, and reel spoke bracing 205 shown in greater detail in FIGS. 17 and 18. The reel 110 of the present embodiment further includes a plurality of reel drum plate supports 206, shown in greater detail in FIGS. 19 and 20, for supporting the reel drum plate 202, which is intended to bear the weight of the coiled tubing 108 thereon. The reel drum plate supports 206 are located to maintain the reel drum plate 202 in a generally circular configuration, except for a radial gap 210 defined in the radial distance of the reel 110, between the ends of the reel drum plate 202. The gap 210 allows an inner end of the coiled tubing to extend to the centre of the reel 110 for connection to a liquid junction 212 of the reel 110. In this regard, the liquid junction 212 is connectable to an input end of the coiled tubing 108, and is connectable to a liquid supplying device (not shown), for conducting the pressurized liquid from the liquid supplying device into the input end of the coiled tubing 108. More particularly still, in this embodiment, the liquid junction 212 includes a high pressure fluid swivel connector 215. The liquid supplying device (not shown) may include a mechanical pump and a hose connectable to the pump and to the liquid junction 212, for example.

Figure 24:
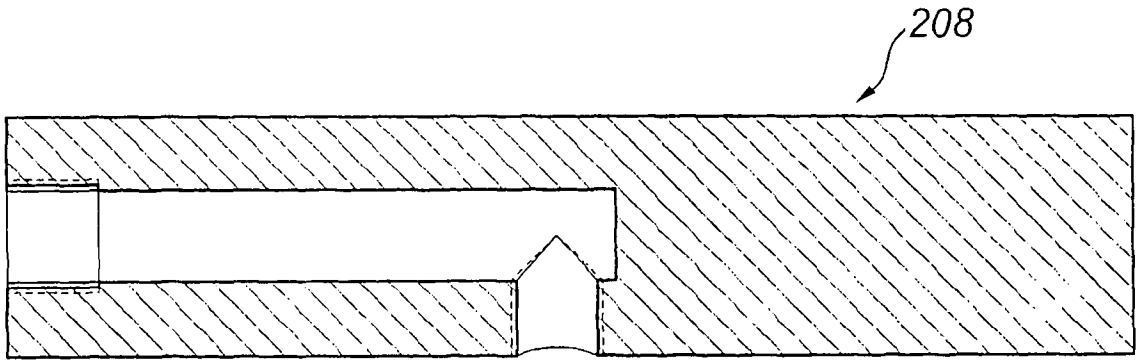
FIGS. 23-24 show a shaft of the reel shown in FIG. 4.
Figure 23:
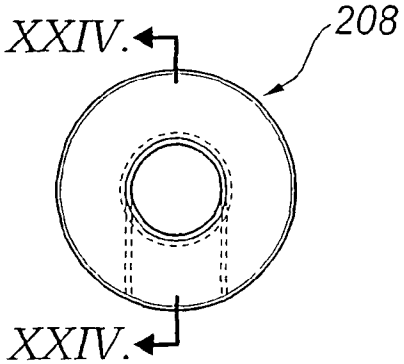
Figure 26:
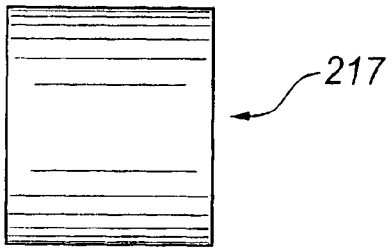
FIGS. 25-26 show a safety pin eye of the reel shown in FIG. 4.
Figure 25:
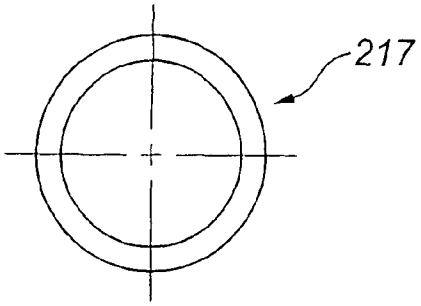
Figure 28:
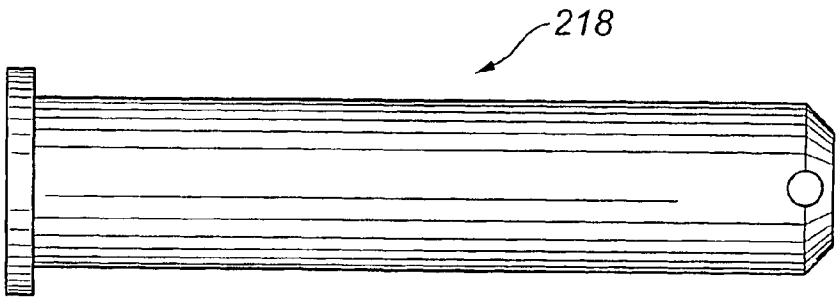
FIGS. 27-28 show a safety pin insertable into the safety pin eye shown in FIGS. 25-26.
Figure 27:
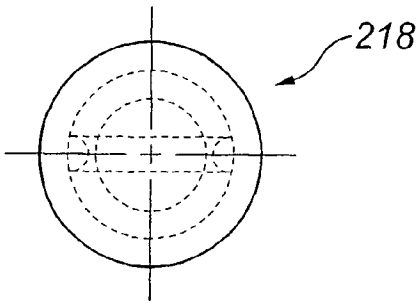

In the present embodiment, the reel 110 includes a bearing 207, a shaft 208 shown in greater detail in FIGS. 23 and 24, and a grease nipple 209. In this embodiment, the reel 110 further includes a plurality of retaining members such as that shown at 216 in FIG. 4. The retaining member 216 is used for retaining the coiled tubing 108 on the reel, effectively retaining the coiled tubing between the retaining members and the reel drum plate 202. More particularly, in this embodiment, the retaining member 216 includes a safety pin eye 217 shown in greater detail in FIGS. 25 and 26, which may include ¾ inch (19 mm) schedule 40 pipe for example, and a safety pin 218 shown in greater detail in FIGS. 27 and 28 insertable into the safety pin eye 217.

Generally, the reel 110 is much smaller than conventional reels used for oilfield applications. In this regard, whereas oilfield applications often require the reel to carry a sufficient length of coiled tubing to extend down to depths of a mile (1.6 kilometres) or more, for the purposes of the present embodiment, the coiled tubing 108 typically does not have to extend more than about 100 feet (30 metres) into the vessel 102. Accordingly, the reel 110 is much smaller than conventional tubing reels.

Insertion Device

Figure 29:
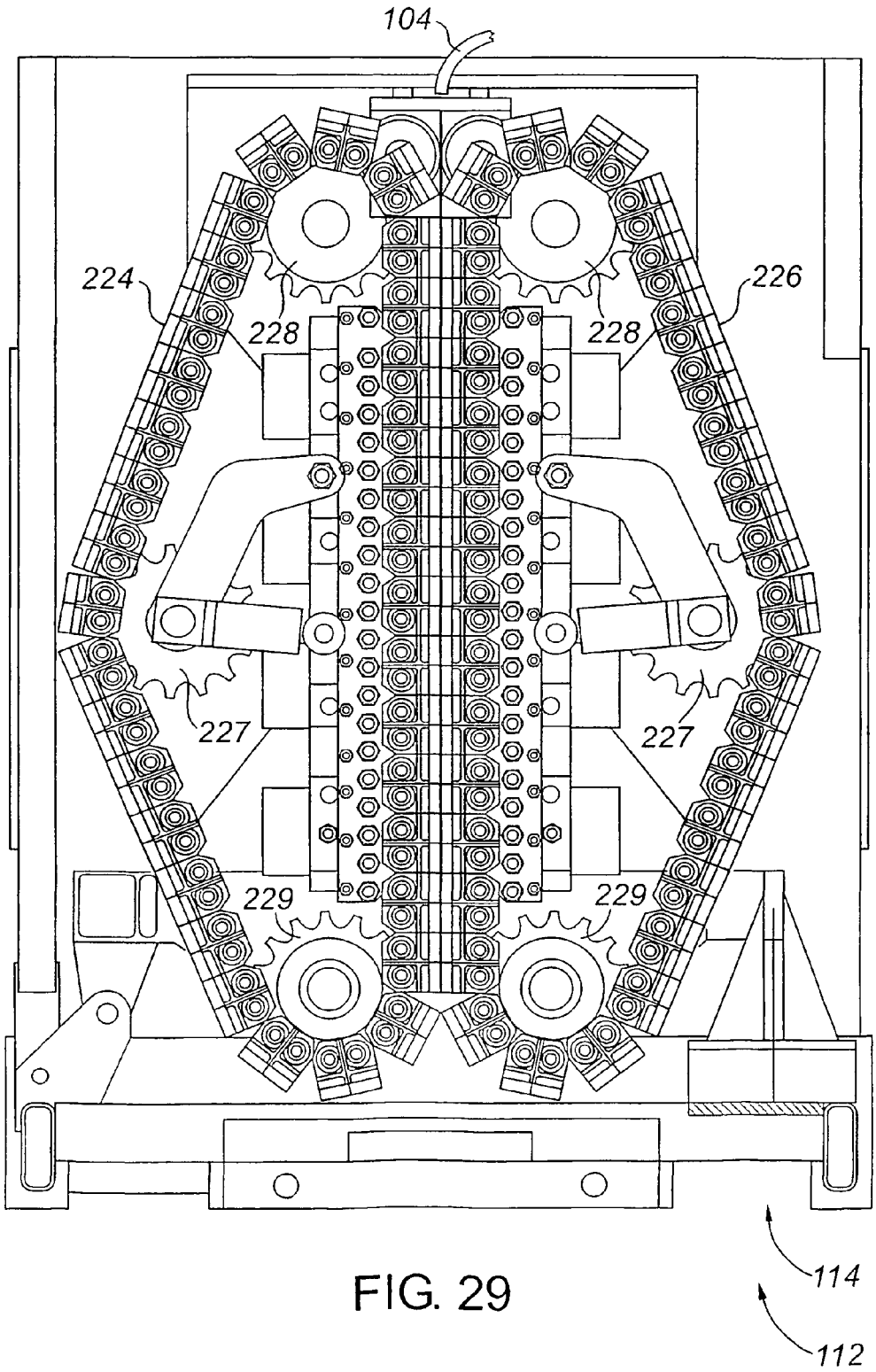
FIG. 29 is a side view of an injector assembly of the apparatus shown in FIG. 1, shown with a cover removed.

Referring to FIG. 29, the insertion device 112, or more particularly, the injector assembly thereof, is shown generally at 114. In this embodiment, the injector assembly 114 includes first and second opposing traction belts 224 and 226 operable to snugly grip the elongated flexible conduit 104 therebetween. In this embodiment, the injector assembly 114 further includes at least one drive mechanism for rotating the traction belts in opposite respective directions to move the flexible conduit 104 through the injector assembly 114. More particularly, in this embodiment, the drive mechanism includes hydraulically operated gears such as those shown at 227, 228 and 229 for example, hydraulically rotatable to forceably rotate the traction belts 224 and 226, to force the coiled tubing 108 into or out of the vessel 102. More particularly still, in the present embodiment the injector assembly 114 employs a power unit comprising a hydraulic motor and planetary gear reducer, to drive the coiled tubing 108 into or out of the vessel as required. The injector assembly 114 also has electronic components (not shown) for monitoring and displaying a length of coiled tubing 108 presently inserted into the vessel 102, and also a current rate of travel of the coiled tubing 108 into or out of the vessel 102.

Generally, the injector assembly 114 shown in FIG. 29 is similar to a scaled down modification of conventional injector assemblies used for oilfield applications. In this regard, it will be appreciated that for downhole oilfield applications, it may be necessary for an injector assembly to apply 100,000 lbs. (450,000 Newtons) of force to pull the coiled tubing 108 back up from depths of more than a mile (1.6 kilometres). In contrast, for the purposes of the present embodiment, the coiled tubing 108 typically does not have to extend more than about 100 feet (30 metres) downward into the vessel 102 and accordingly, the injector assembly 114 of the present embodiment typically does not need to pull the coiled tubing with a force greater than about 2,000 lbs. (9,000 Newtons). Accordingly, to minimize the weight of the injector assembly 114, which must be supported on the support frame 140, a significantly smaller and more lightweight injector assembly is provided in the present embodiment.

First Sealing Device

Figure 30:
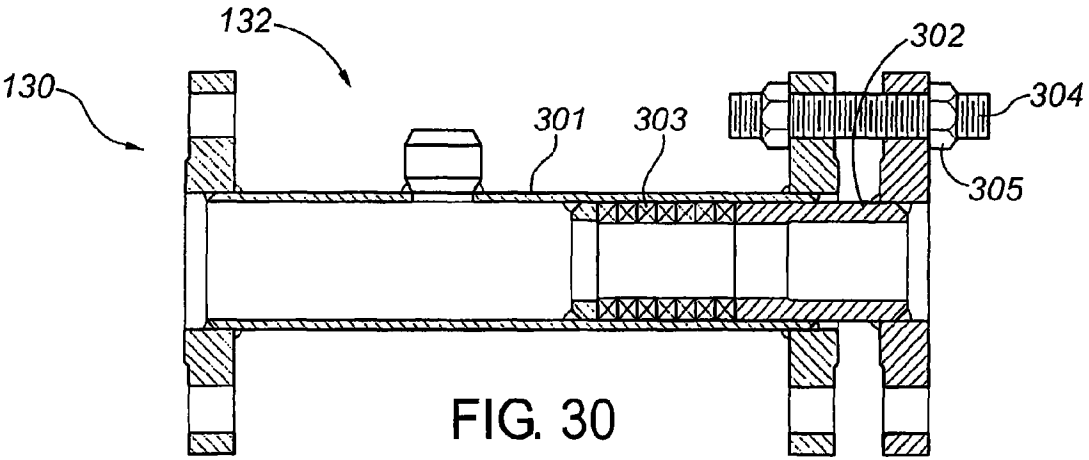
FIG. 30 is a cross-section of a coiled tubing pack-off of the apparatus shown in FIG. 1.

Referring to FIGS. 30 through 45, the first sealing device is shown in greater detail at 130 in FIG. 30. In this embodiment, the first sealing device 130 includes the coiled tubing pack-off 132. More particularly, in this embodiment, the coiled tubing pack-off 132 includes a tube assembly 301 shown in greater detail in FIG. 31 and a cylinder assembly 302 shown in FIGS. 32 and 33. The coiled tubing pack-off 132 further includes square packing 303, such as $\frac{3}{8}^{th}$ inch (10 mm) square packing, for example. The coiled tubing pack-off 132 further includes a plurality of studs 304 and a plurality of nuts 305, which in this embodiment include eight studs and sixteen nuts respectively.

Figure 31:
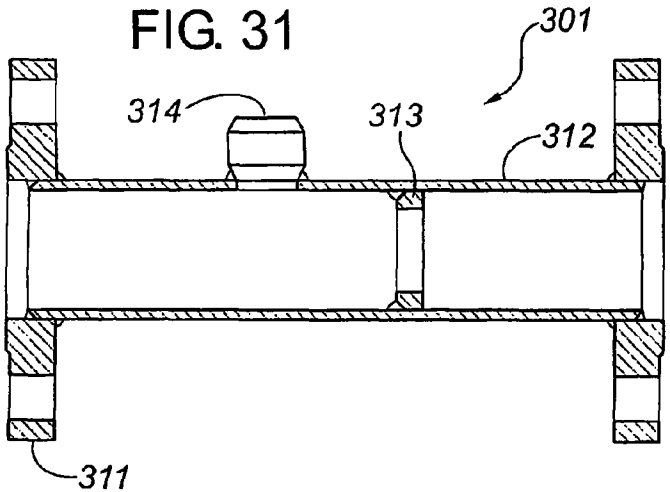
FIG. 31 is a cross-section of a tube assembly of the coiled tubing pack-off shown in FIG. 30.
Figure 34:
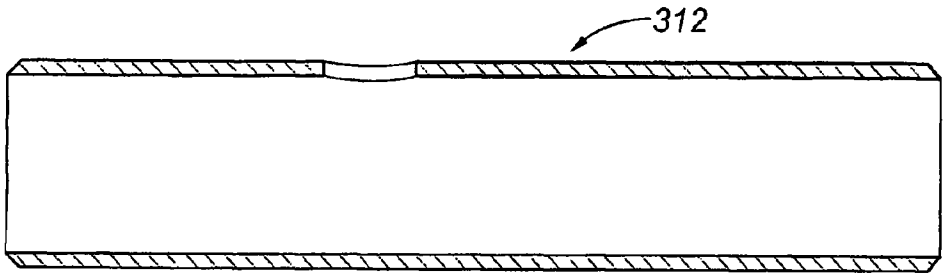
FIGS. 34-36 show a flange connector of the tube assembly shown in FIG. 31.
Figure 35:
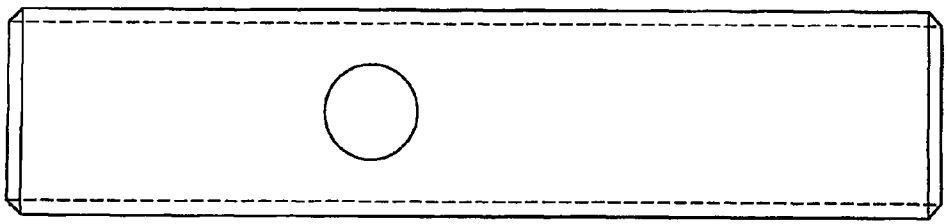
Figure 36:
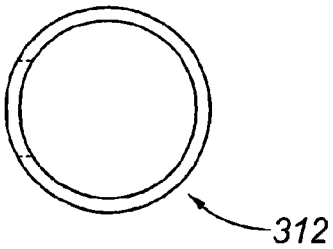
Figure 38:
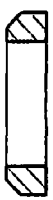
FIGS. 37-38 show a retailing ring of the tube assembly shown in FIG. 31.
Figure 37:
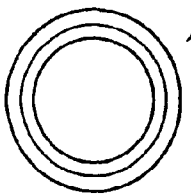
Figure 41:
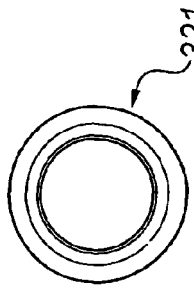
FIGS. 39-41 show a packing cylinder of the cylinder assembly shown in FIG. 33.
Figure 40:
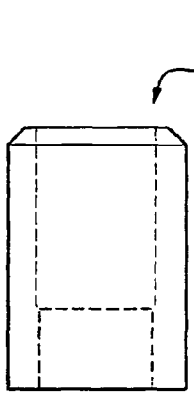
Figure 39:
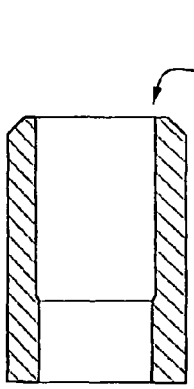
Figure 43:
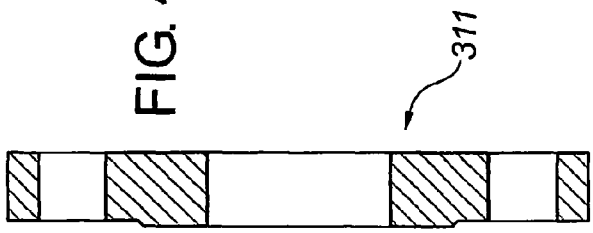
FIGS. 42-43 show a flange of the tube assembly shown in FIG. 31.
Figure 42:
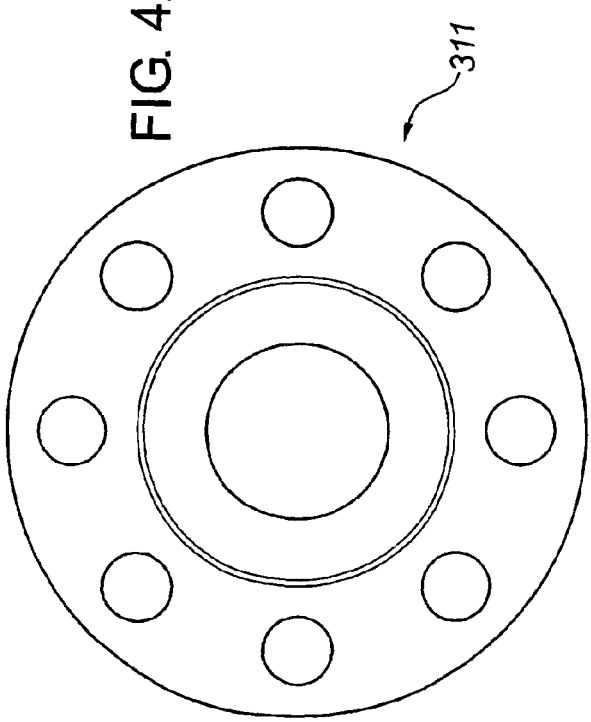
Figure 45:
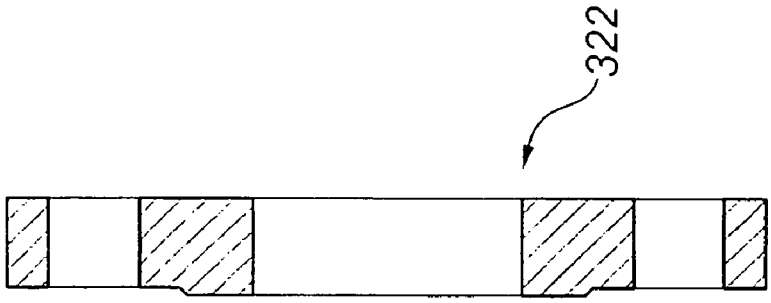
FIGS. 44-45 show a packing cylinder flange of the cylinder assembly shown in FIG. 33.
Figure 44:
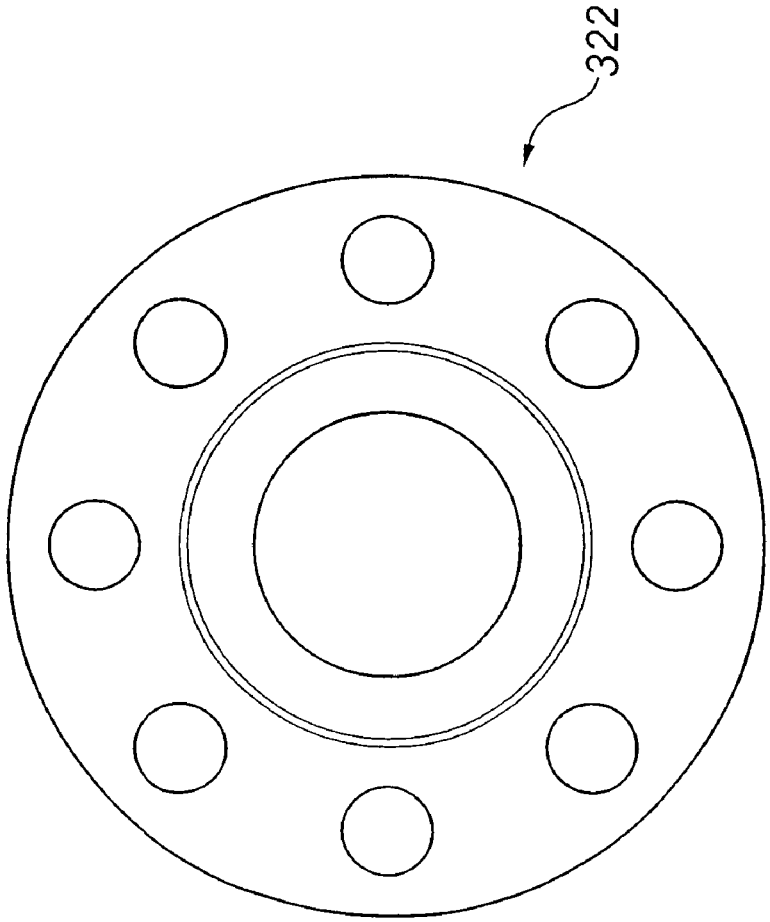

Referring to FIGS. 31 through 45, the tube assembly 301 of the coiled tubing pack-off 132 is shown in greater detail in FIG. 31. In this embodiment, the tube assembly 301 includes a flange 311 shown in greater detail in FIGS. 42 and 43. The tube assembly 301 further includes a flange connector 312 shown in greater detail in FIGS. 34 through 36. In the present embodiment, the tube assembly 301 further includes a retaining ring 313, shown in greater detail in FIGS. 37 and 38. The tube assembly 301 further includes a canvil 314 shown in FIG. 31.

During use of the apparatus 100, steam or some other fluid may be injected into the first sealing device 130, such as at the location of the canvil 314. Injection of this fluid may help to cool the coiled tubing 108 as it passes through the first sealing device 130 and to clean the coiled tubing 108 as it is being removed from the vessel 102 so that fouling of the square packing 303 is minimized.

Figure 32:
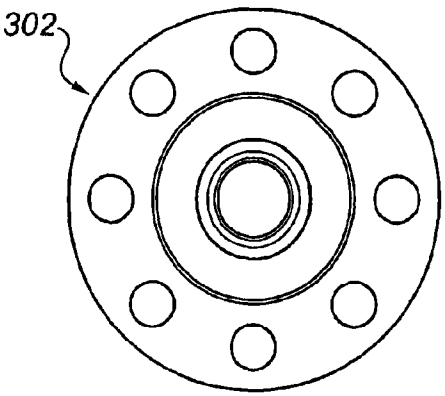
FIG. 32 is an axial view of a cylinder assembly of the coiled tubing pack-off shown in FIG. 30.
Figure 33:
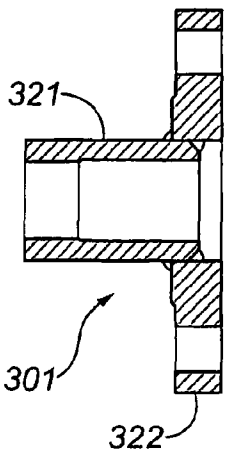
FIG. 33 is a cross-section of the cylinder assembly shown in FIG. 32.

Referring to FIGS. 32 through 45, in this embodiment, the cylinder assembly 302 of the coiled tubing pack-off 132 is shown in greater detail in FIGS. 32 and 33. In this embodiment, the cylinder assembly 302 includes a packing cylinder 321 shown in greater detail in FIGS. 39 through 41, and further includes a packing cylinder flange 322, shown in greater detail in FIGS. 44 and 45.

Referring back to FIG. 2, generally, in the present embodiment, the coiled tubing pack-off 132 is installed onto the rear of the shroud valve 138, and serves to provide a seal between the inside of the shroud 116 and the coiled tubing 108. The coiled tubing pack-off 132 may also serve to provide a seal between the shroud 116 and the shroud valve 138.

Rigid Conduit

Figure 46:
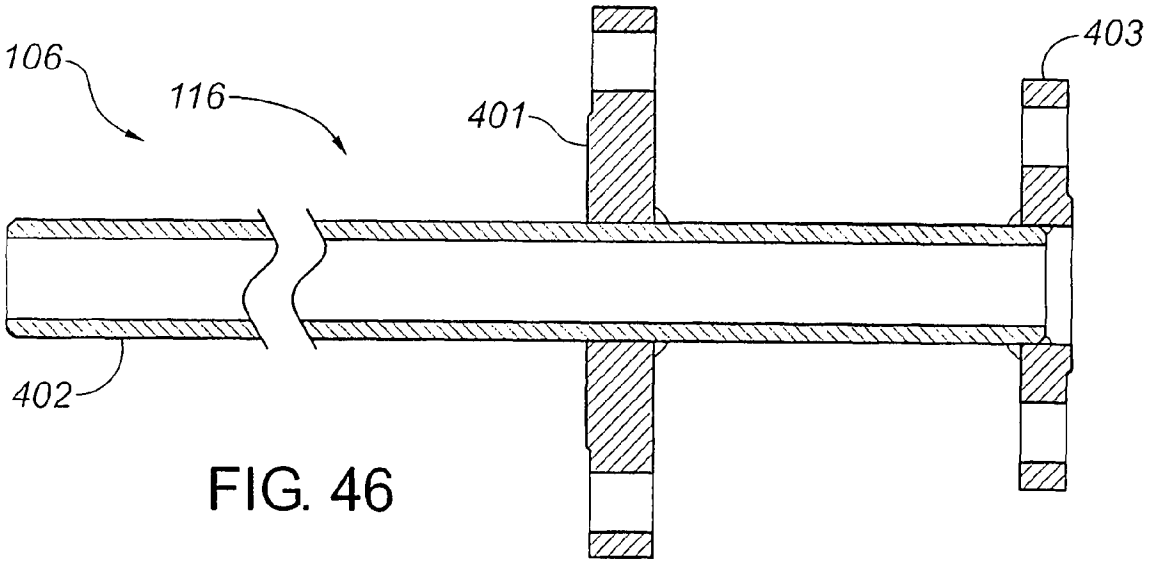
FIG. 46 is a cross-section of a rigid conduit of the apparatus shown in FIG. 1.
Figure 48:
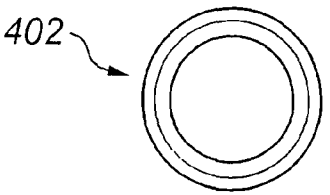
FIGS. 47-48 show a shroud tube of the rigid conduit shown in FIG. 46.
Figure 47:
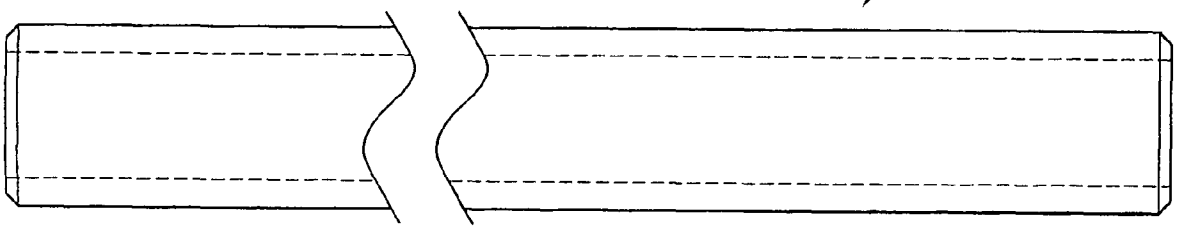
Figure 49:
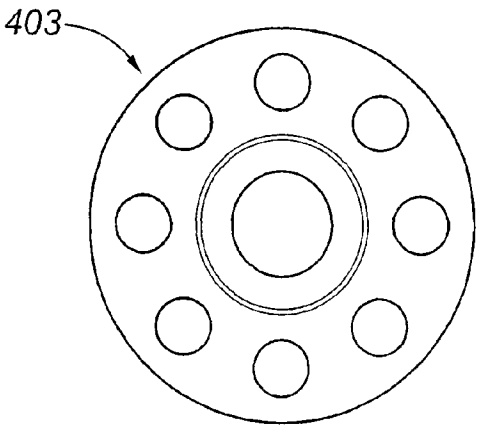
FIGS. 49-50 show a shroud flange of the rigid conduit shown in FIG. 46.
Figure 50:
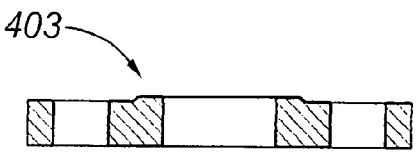
Figure 51:
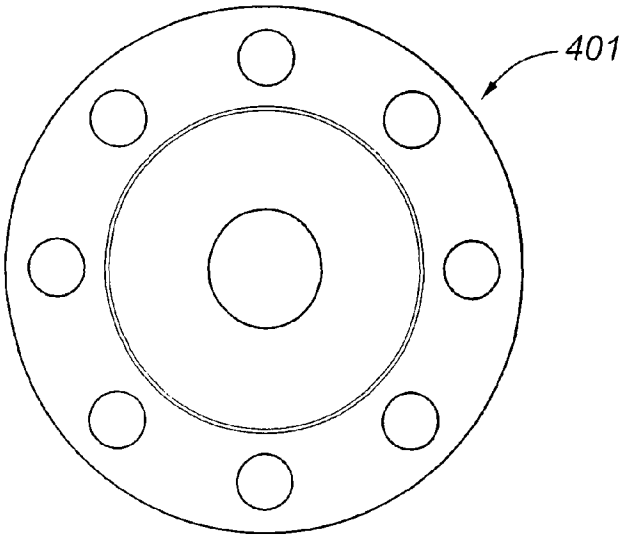
FIGS. 51-52 show another shroud flange of the rigid conduit shown in FIG. 36.
Figure 52:
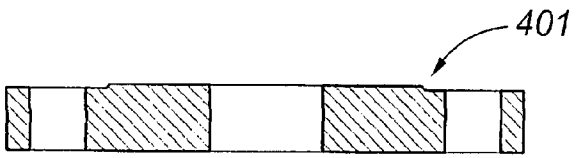

Referring to FIGS. 2 and 46 through 52, the rigid conduit 106, or more particularly, the rigid shroud 116, is shown in greater detail in FIG. 46. In this embodiment, the rigid shroud 116 includes a shroud tube 402 shown in greater detail in FIGS. 47 and 48, a first shroud flange 401 shown in greater detail in FIGS. 51 and 52, and a second shroud flange 403 shown in greater detail in FIGS. 49 and 50. Referring back to FIG. 2, generally, in the present embodiment, the shroud 116 is installed through the shroud pack-off 136 and through the existing valve assembly 122 into the vessel 102. The rigid shroud 116 serves to support the coiled tubing 108 so that the flexible coiled tubing may extend into the vessel 102 to reach a cyclone snout (not shown in FIG. 2), and extend down through the snout to clean the snout and other components below the snout.

Second Sealing Device

Figure 53:
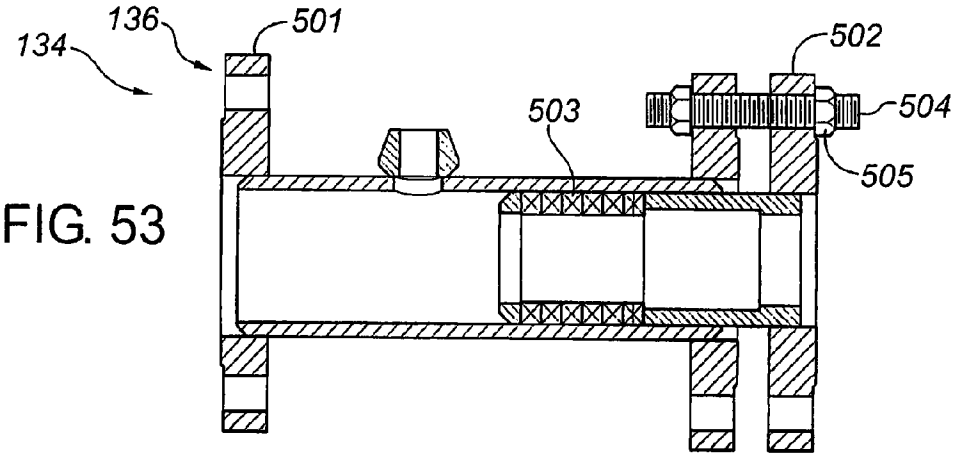
FIG. 53 is a cross-section of a shroud pack-off of the apparatus shown in FIG. 1.

Referring to FIGS. 2 and 53 through 74, the second sealing device 134, which in this embodiment includes the shroud pack-off 136, is shown in greater detail in FIG. 53. In this embodiment, the shroud pack-off 136 includes a tube assembly 501 shown in greater detail in FIGS. 54 and 55, and a cylinder assembly 502 shown in greater detail in FIGS. 56 and 57. The shroud pack-off 136 further includes square packing 503, a plurality of studs 504, and a plurality of nuts 505 (in this embodiment, eight studs and sixteen nuts).

Figure 54:
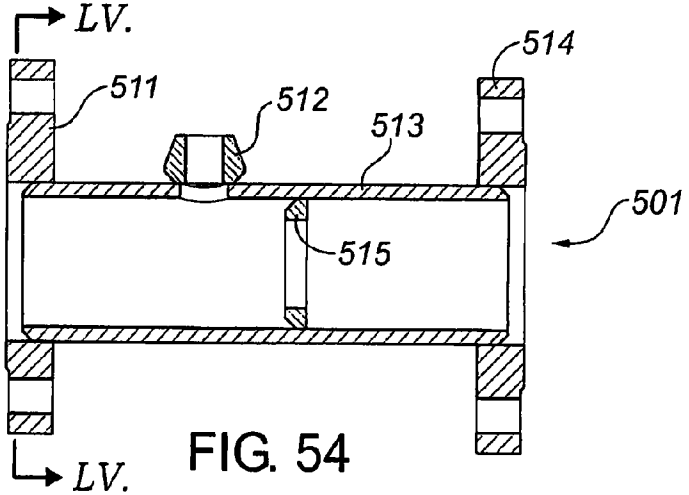
FIGS. 54-55 show a tube assembly of the shroud pack-off shown in FIG. 53.
Figure 55:
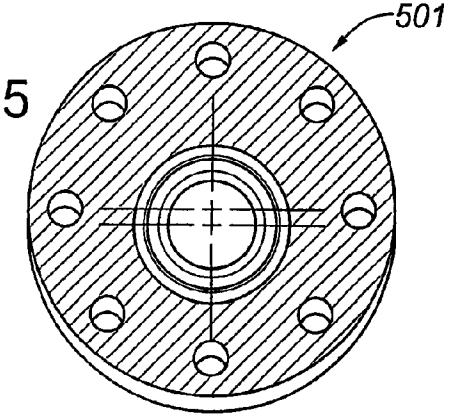

Referring to FIGS. 54 through 74, the tube assembly 501 of the shroud pack-off 136 is shown in greater detail in FIG. 54. In this embodiment, the tube assembly 501 includes a front flange 511 shown in greater detail in FIGS. 60 and 61, a canvil 512, a flange connector 513 shown in greater detail in FIGS. 62 through 64, a rear flange 514 shown in greater detail in FIGS. 58 and 59, and a retainer ring 515 shown in greater detail in FIGS. 65 and 66.

Figure 57:
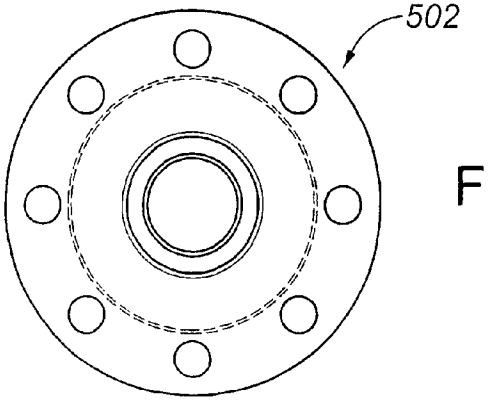
FIGS. 56-57 show a cylinder assembly of the shroud pack-off shown in FIG. 53.
Figure 56:
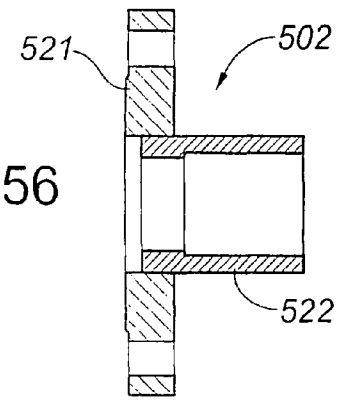
Figure 59:
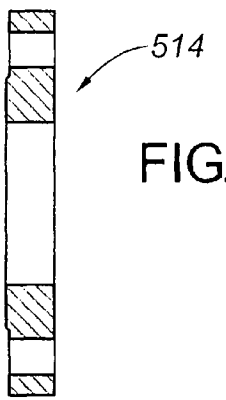
FIGS. 58-59 show a rear flange of the tube assembly shown in FIG. 54.
Figure 58:
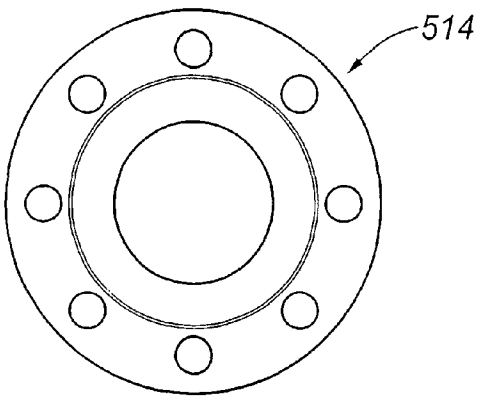
Figure 61:
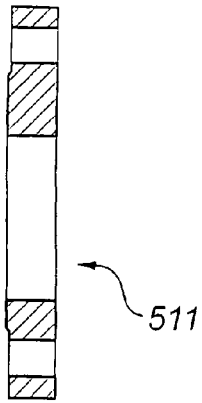
FIGS. 60-61 show a front flange of the tube assembly shown in FIG. 54.
Figure 60:
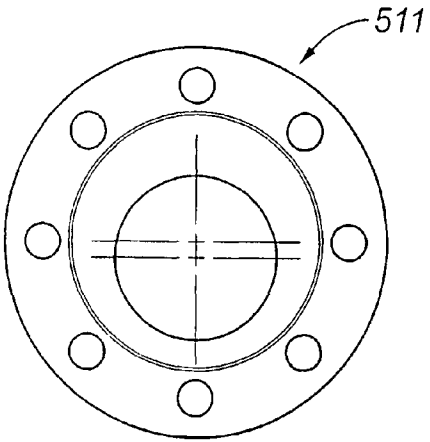
Figure 62:
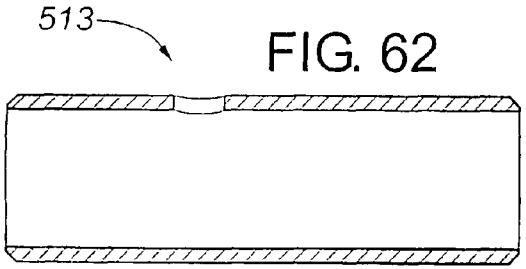
FIGS. 62-64 show a flange connector of the tube assembly shown in FIG. 54.
Figure 63:
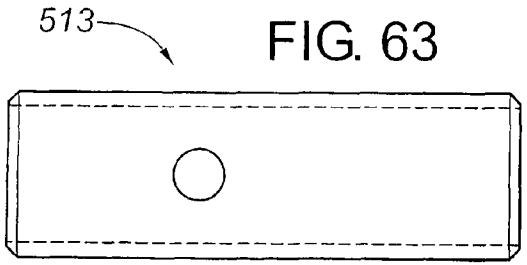
Figure 64:
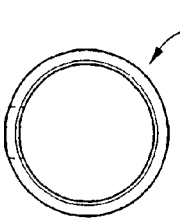
Figure 72:
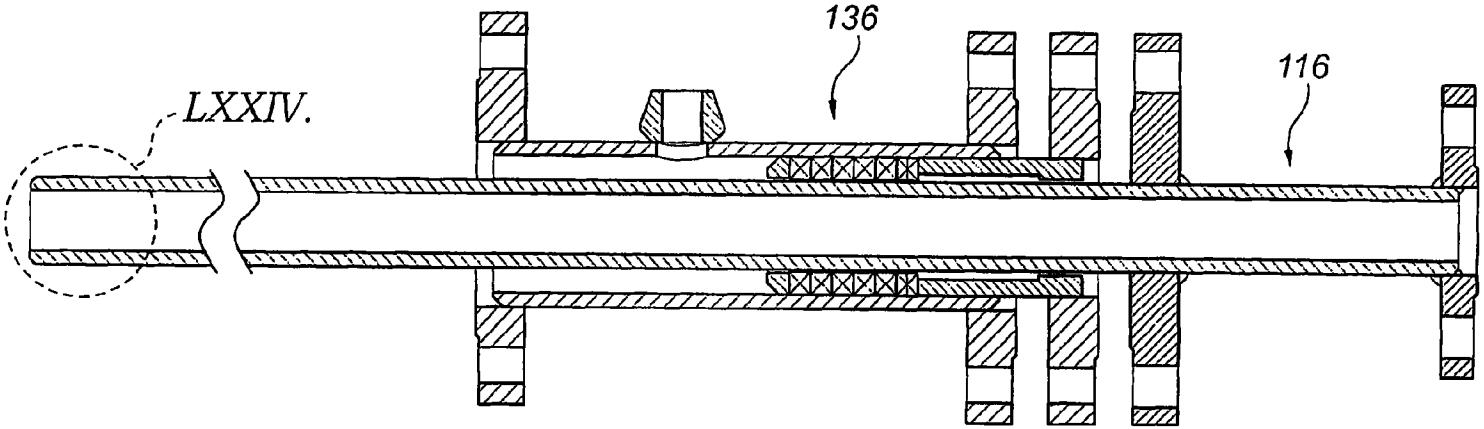
Figure 73:
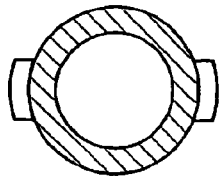
FIGS. 73-74 show a detail of the rigid conduit and shroud pack-off shown in FIG. 72.
Figure 74:
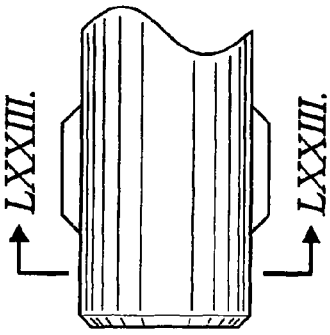

Referring to FIGS. 56 through 74, the cylinder assembly 502 of the shroud pack-off 136 is shown in greater detail in FIGS. 56 and 57. In this embodiment, the cylinder assembly 502 includes a packing cylinder flange 521 shown in greater detail in FIGS. 67 and 68, and further includes a packing cylinder 522 shown in greater detail in FIGS. 69 through 71. Referring to FIGS. 46, 53 and 72 through 74, the shroud 116 shown in FIG. 46 and the shroud pack-off 136 shown in FIG. 53, are shown assembled together in FIG. 72. Referring to FIGS. 73 and 74, if desired, blow out prevention stops may be welded on after insertion of the shroud 116 into a packing gland defined by the shroud pack-off.

As is the case with respect to the first seating device 130, during use of the apparatus 100, steam or some other fluid may be injected into the second sealing device 134, such as at the location of the canvil 512. Injection of this fluid may help to cool the coiled tubing 108 as it passes through the second sealing device 134 and to clean the coiled tubing 108 as it is being removed from the vessel 102 so that fouling of the square packing 503 is minimized.

Coker Vessel

Figure 75:
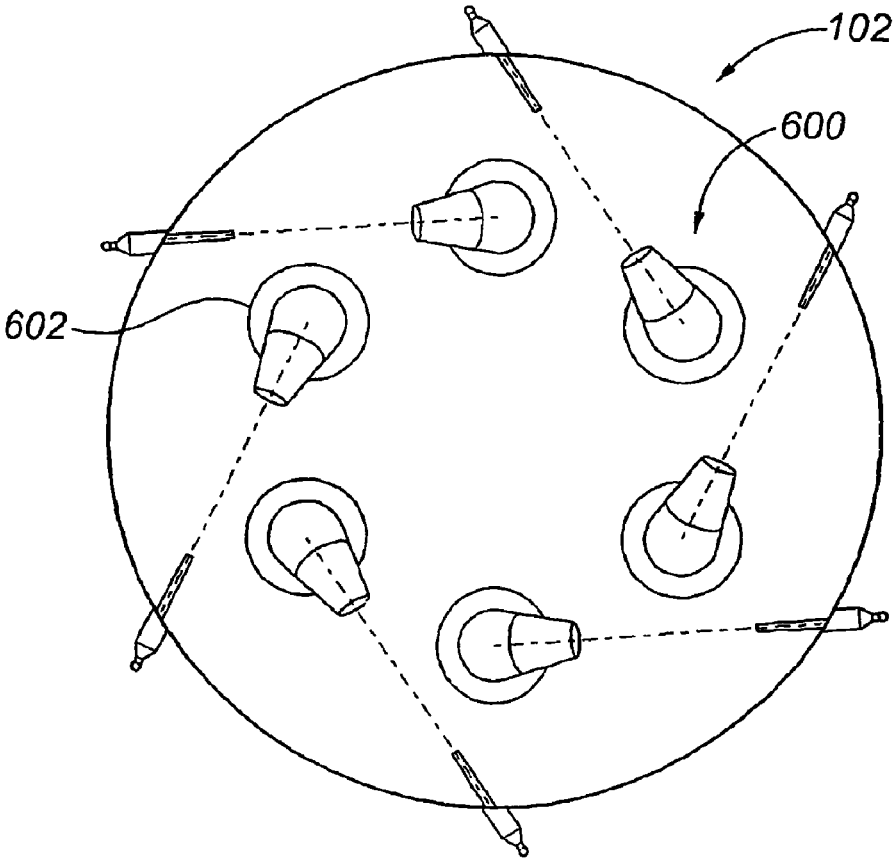
FIGS. 75-76 show a coker vessel to be cleaned by the apparatus shown in FIG. 1.
Figure 76:
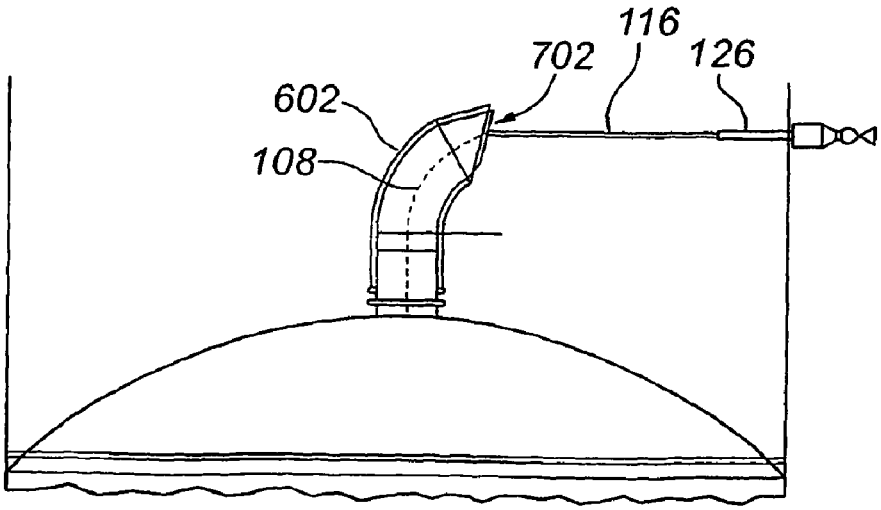
Figure 77:
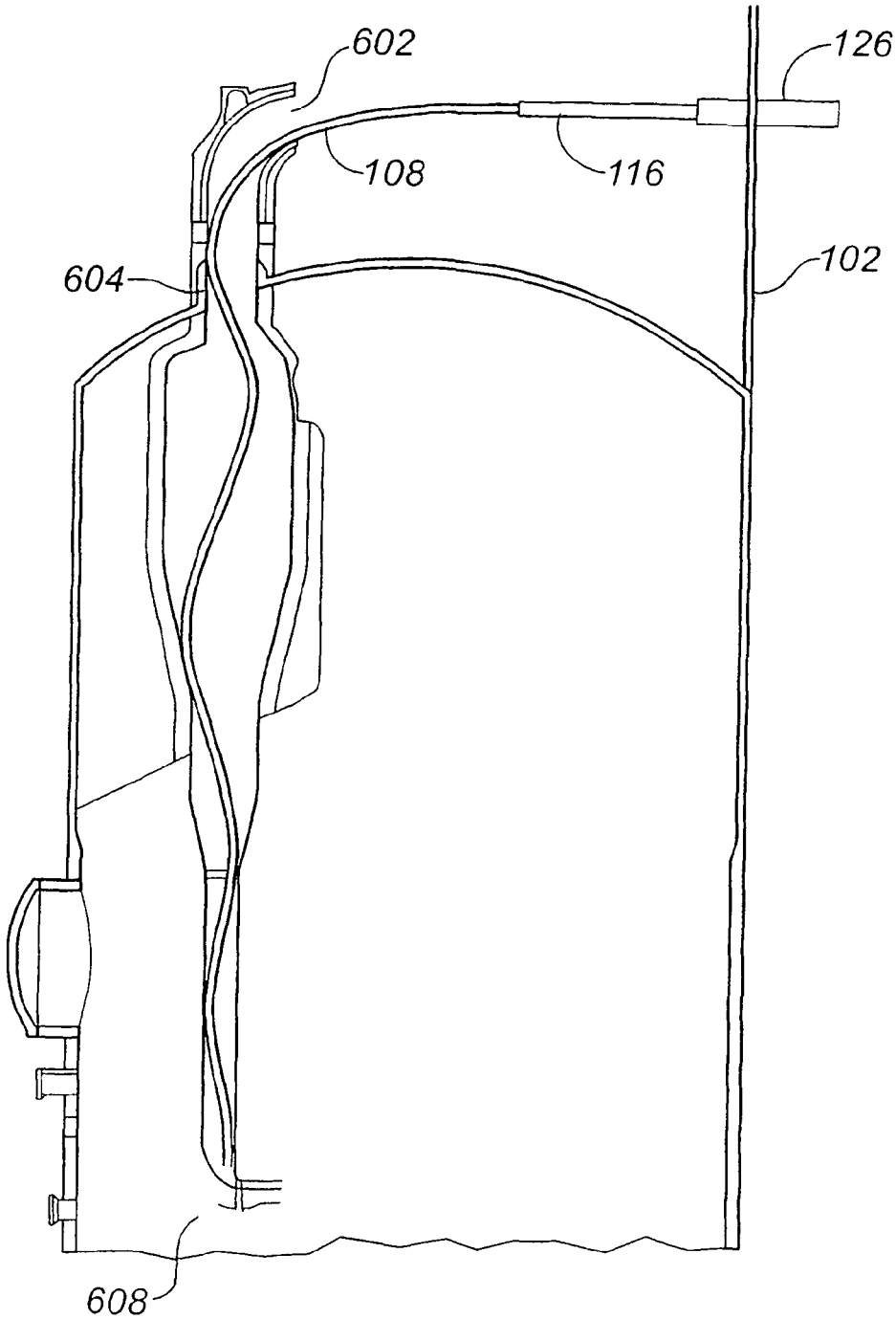
FIG. 77 shows a flexible conduit of the apparatus shown in FIG. 1, inserted into the coker vessel shown in FIGS. 75 and 76.

Referring to FIGS. 75 through 77, the vessel 102, which in this embodiment includes a coker vessel, is shown in greater detail in FIG. 75. In this embodiment, the vessel 102 is a dense phase cyclone reactor coker vessel manufactured by Exxon Corporation, for extracting crude oil from solid materials. The coker vessel 102 has a plurality of cyclone snouts shown generally at 600, disposed circumferentially around an upper inside region of the coker vessel. Each cyclone snout, such as that shown at 602 for example, includes a 24 inch (61 centimetre) elbow joint, and is in communication with a respective 24 inch (61 centimetre) gas tube, such as that shown at 604 in FIG. 77 for example, extending vertically downward within the coker vessel. Below each gas tube is a void area for providing a cyclone effect, below which a dip leg extends beneath the void area.

Referring back to FIGS. 1 and 77, in this embodiment, the coker vessel is on the order of 100 metres (several hundred feet) tall, and the existing valve assembly 122 protrudes from the wall 120 of the vessel 102 at a height of approximately 220 feet (67 metres) above the ground, or about 85 feet (26 metres) above a vicinity 608 of the dip leg.

Operation

Referring to FIGS. 2 and 75 through 77, for operation of the apparatus 100 shown in FIG. 2, the apparatus is first installed onto the vessel 102 while the vessel is live (i.e., in operation). In this regard, the shroud pack-off 136 is installed onto a rear or outside end of the existing valve assembly 122, and selves to provide a seal between the inside of the existing valve assembly 122 and the outside of the shroud 116. The shroud 116 is installed through the shroud pack-off 136 and through the existing valve assembly, to extend into the vessel 102.

Referring back to FIG. 72, the shroud 116 is mechanically attached to the shroud pack-off 136.

Referring to FIGS. 2, 3 and 75 though 77, the shroud 116 extends sufficiently far into the vessel 102 to support the coiled tube 108 to allow the coiled tubing 108 to be inserted into one of the cyclone snouts 600. The shroud valve 138 is installed at a rear or outside region of the shroud 116, and serves to provide a seal preventing gases travelling into or out of the vessel 102 at least temporarily, until the coiled tubing pack-off 132 is installed and the coiled tubing 108 has been inserted through the coil tubing pack-off 132. The coiled tubing pack-off 132 is installed onto a rear region of the shroud valve 138, and serves to provide a seal between the inside of the shroud 116 and shroud valve 138 and the outside of the coiled tubing 108. The injector assembly 114 is mechanically attached to a rear of the coiled tubing pack-off 132. The injector assembly 114 employs its hydraulic motor and planetary gear reducer to drive the coiled tubing 108 into or out of the vessel as required, and the electronic components of the injector assembly monitor and display the length of coiled tubing 108 presently inserted into the vessel 102, as well as the current rate of travel of the coiled tubing 108 into or out of the vessel 102.

The coiled tubing 108 has an input end connected to the liquid junction 212 at the centre of the reel 110, and is coiled around the reel. An output end of the coiled tubing extends off the reel, through the injector assembly 114, through the coiled tubing pack-off 132, the shroud valve 138, the shroud 116 and extends through the shroud 116 into the vessel 102. The coiled tubing 108 includes a cleaning nozzle 700 at an output end thereof. The coiled tubing transports high pressure water from the liquid junction 212 of the reel 110 to the cleaning nozzle 700 and out therethrough, to clean the cyclone snout 602 and regions of the vessel 102 further down, in and below the gas tube 604, down to the vicinity 608 of the dip leg.

The reel 110 is mounted on the support frame 140 behind the injector assembly 114, and serves to store the coiled tubing 108 and maintain tension of the coiled tubing to prevent it from unspooling. The support frame 140 serves to support the injector assembly 114 and the reel 110.

Thus, in the present embodiment, to use the apparatus 100 to clean components of the vessel 102, the elongated flexible conduit 104 is inserted through the elongated rigid conduit into the vessel 102, and pressurized liquid is conducted through the flexible conduit 104 into the vessel 102 to clean the vessel.

More particularly, referring to FIGS. 2 and 76, the rigid shroud 116 extends into the vicinity of a mouth 702 of the cyclone snout 602. The injector assembly 114 forces the coiled tubing 108 through the rigid shroud 116 and through the mouth 702 of the cyclone snout 602. As the nozzle 700 of the coiled tubing 108 enters the mouth 702 of the cyclone snout 602, high pressure pumps are activated to supply water through the liquid junction of the reel 110, through the input end of the coiled tubing 108, and out through the nozzle 700 of the coiled tubing 108, into the cyclone snout 602. The high pressure pumps (not shown) force the water through the nozzle 700 at a high pressure, which in the embodiment is at least 5,000 psi. More particularly, in this embodiment, the water pressure is 10,000 psi, for cleaning hardened coke from the cyclone snout 602 and other components of the vessel 109.

Once the nozzle has been inserted into the mouth 702 of the cyclone snout 602 and the high pressure liquid flow has been commenced, the injector assembly 114 slowly injects the coiled tubing further into the vessel 102. The shape of the cyclone snout 602 assists in guiding the nozzle 700 of the coiled tubing 108 in a generally downward direction as the injector assembly continues to inserts additional length of the coiled tubing 108 into the vessel 102. Thus, as the coiled tubing 108 is gradually inserted into the vessel 102, the high pressure water flow from the nozzle 700 gradually cleans the cyclone snout 602 by forceably removing coke build-up from the inside of the cyclone snout 602. This coke removal cleaning action continues as the nozzle 700 moves further down through the gas tube 604, and coke build-up is thus similarly removed from the gas tube. The injector assembly 114 continues to gradually insert the coiled tubing 108 into the vessel 102, so that the nozzle 700 of the coiled tubing 108 extends progressively further downward through the gas tube, through the cyclone effect void beneath the gas tube, and into the vicinity 608 of the dip leg, to remove coke build-up from the dip leg. When the display on the injector assembly indicates that a sufficient length of coiled tubing 108 has been inserted into the vessel 102 to place the nozzle 700 in the vicinity of the dig leg, the insertion of the coiled tubing into the vessel 102 by the injector assembly 114 is halted. The injector assembly 114 may be reversed, to begin pulling the coiled tubing 108 back out of the vessel 102.

While specific embodiments of the invention have been described and illustrated, such embodiments should be considered illustrative of the invention only and not as limiting the invention as construed in accordance with the accompanying claims.

The invention claimed is:

1. An apparatus for cleaning a vessel, the apparatus comprising:

a) an elongated rigid conduit insertable into the vessel such that the rigid conduit extends therein; and b) an elongated flexible conduit insertable through the rigid conduit into the vessel, for conducting pressurized liquid into the vessel to clean the vessel, said elongated flexible conduit sufficiently long to extend beyond an innermost end of said rigid conduit when said elongated flexible conduit is inserted into said vessel and the apparatus further comprising a sealing device for sealing a gap between said flexible conduit and the rigid conduit to prevent fluid from travelling through the gap.

2. An apparatus for cleaning a vessel, the apparatus comprising an elongated flexible conduit insertable through a rigid conduit extending into the vessel and having an innermost end terminating therein, said elongated flexible conduit sufficiently long to extend beyond the innermost end of said rigid conduit when said elongated flexible conduit is inserted into said vessel, said elongated flexible conduit conducting pressurized fluid into the vessel to clean the vessel wherein said rigid conduit is insertable through an elongated rigid valve assembly extending through a wall of the vessel, the apparatus further comprising a sealing device for sealing a gap between said rigid conduit and the valve assembly to prevent fluid from travelling through the gap and a second sealing device for sealing a second gap between said flexible conduit and the rigid conduit to prevent fluid from travelling through the second gap.

3. An apparatus for cleaning a vessel, the apparatus comprising an elongated flexible conduit insertable through a rigid conduit extending into the vessel and having an innermost end terminating therein, said elongated flexible conduit sufficiently long to extend beyond the innermost end of said rigid conduit when said elongated flexible conduit is inserted into said vessel, said elongated flexible conduit conducting pressurized fluid into the vessel to clean the vessel, and the apparatus further comprising a sealing device for sealing a gap between said flexible conduit and the rigid conduit to prevent fluid from travelling through the gap.

4. An apparatus for cleaning a vessel, the apparatus comprising: a) an elongated rigid conduit insertable into the vessel such that the rigid conduit extends therein; and b) an elongated flexible conduit insertable through the rigid conduit into the vessel, for conducting pressurized liquid into the vessel to clean the vessel, said elongated flexible conduit sufficiently long to extend beyond an innermost end of said rigid conduit when said elongated flexible conduit is inserted into said vessel, wherein said rigid conduit is insertable through an elongated rigid valve assembly extending through a wall of the vessel, the apparatus further comprising a sealing device for sealing a gap between said rigid conduit and the valve assembly to prevent fluid from travelling through the gap, and a second sealing device for sealing a second gap between said flexible conduit and the rigid conduit to prevent fluid from travelling through the second gap.

5. An apparatus for cleaning a vessel, the apparatus comprising:

a. an elongated rigid conduit insertable into the vessel such that the rigid conduit extends therein;

b. an elongated flexible conduit insertable through the rigid conduit into the vessel, for conducting pressurized liquid into the vessel to clean the vessel, said elongated flexible conduit sufficiently long to extend beyond an innermost end of said rigid conduit when said flexible conduit is inserted into said vessel; and c. a sealing device for sealing a gap between the flexible conduit and the rigid conduit to prevent fluid from travelling through the gap.

6. An apparatus for cleaning a vessel, the apparatus comprising:

a. an elongated rigid conduit insertable into the vessel such that the rigid conduit extends therein, wherein the rigid conduit is insertable through an elongated rigid valve assembly extending through a wall of the vessel;

b. a sealing device for sealing a gap between the rigid conduit and the valve assembly to prevent fluid from travelling through the gap;

c. an elongated flexible conduit insertable through the rigid conduit into the vessel, for conducting pressurized liquid into the vessel to clean the vessel, said elongated flexible conduit sufficiently long to extend beyond an innermost end of said rigid conduit when said flexible conduit is inserted into said vessel; and d. a further sealing device for sealing a gap between the flexible conduit and the rigid conduit to prevent fluid from travelling through the gap.

* * * * *